United States Patent [19]

Nishiuchi et al.

[11] Patent Number: 5,007,266

[45] Date of Patent: Apr. 16, 1991

[54] SUCCESSIVE COLD WORKING PROCESS

[75] Inventors: Shohachi Nishiuchi; Shigeo Ohta; Hitoshi Imai; Haruo Meguro, all of Saitama, Japan

[73] Assignee: Honda Giken Kogyo Kabushiki Kaisha, Tokyo, Japan

[21] Appl. No.: 320,466

[22] Filed: Mar. 8, 1989

[51] Int. Cl.[5] ..... B21J 3/00; B21C 23/32; B21K 1/00

[52] U.S. Cl. ..... 72/44; 72/358; 72/352

[58] Field of Search ..... 72/41, 43, 44, 45, 354, 72/356, 358, 359, 364

[56] References Cited

U.S. PATENT DOCUMENTS 4,586,365 5/1986 Henkelmann ..... 72/45 X

FOREIGN PATENT DOCUMENTS 55-60238 4/1980 Japan .
56-165540 12/1981 Japan ..... 72/41
59-82133 5/1984 Japan ..... 72/45
59-150639 8/1984 Japan .
59-220243 12/1984 Japan .
60-115343 6/1985 Japan .
61-255737 11/1986 Japan ..... 72/43
63-41665 8/1988 Japan .

*Primary Examiner*—E. Michael Combs
*Attorney, Agent, or Firm*—Irving M. Weiner; Joseph P. Carrier; Pamela S. Burt

[57] ABSTRACT

A billet is successively cold worked into a product such as a countershaft, an outer race for a constant-velocity joint, or the like by forming a chemically converted lubricating coating on a surface of the billet, forging the billet into an intermediate product at a temperature below a transformation temperature of the billet, covering a surface of said intermediate product with lubricating oil in a die cavity in a die assembly, and forging the intermdiate product at a temperature below the transformation temperature and before the intermediate product gains a predetermined hardness due to age hardening resulting from the first forging step.

20 Claims, 20 Drawing Sheets

FIG. 5
| REMOVAL TIME (SEC) | REM-OVAL | 18 | 38 | 90 | 150 | 287 | 600 | 870 | 1800 | WATER-COOLED |
|---|---|---|---|---|---|---|---|---|---|---|
| TEMPERATURE °C | 230°C | 229 | 226 | 219 | 213 | 194 | 144 | 136 | 110 | 30 |
| HARDNESS HRB | | 85 | 88 | 88 | 88 | 90.7 | 93 | 92.8 | 94.6 | 96.4 |
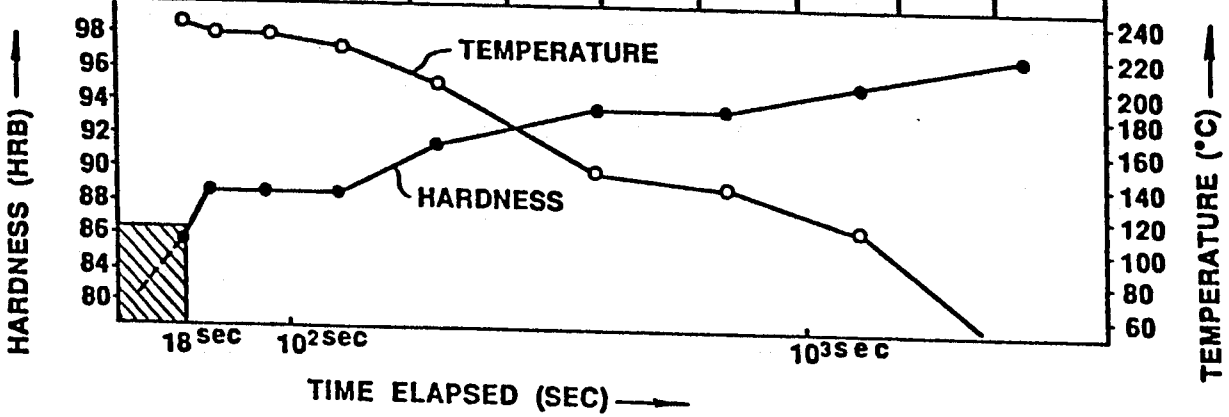
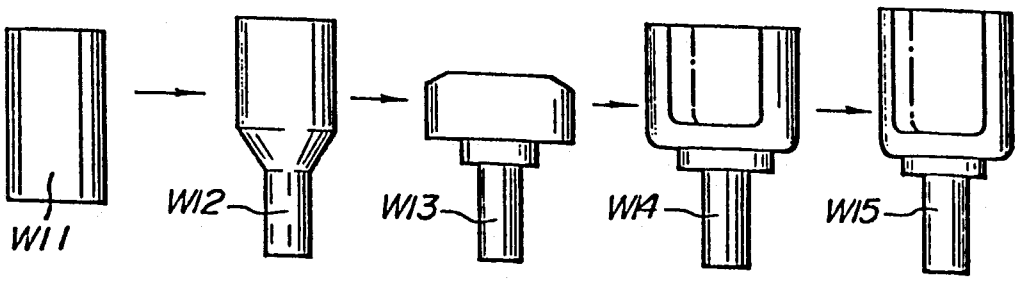
FIG. 6 A
FIG. 6 B
FIG. 6 C
FIG. 6 D
FIG. 6 E 62
61
64
W13
65
63

62
61
64
63
W13
O
65

62
64
S
W13
65

62
64
61
W14
65

62
64
61
W14
65

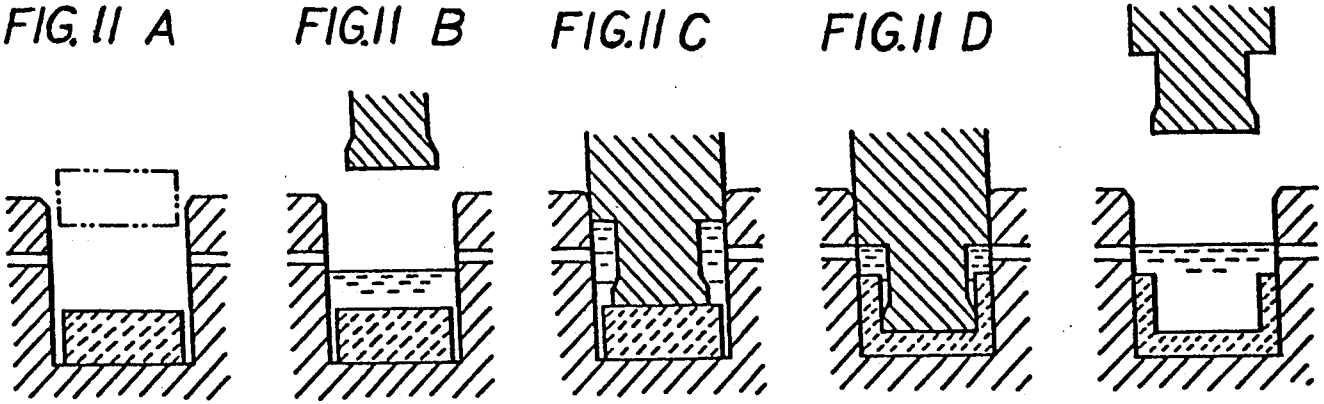
FIG. 11 A
FIG. 11 B
FIG. 11 C
FIG. 11 D
FIG. 11 E
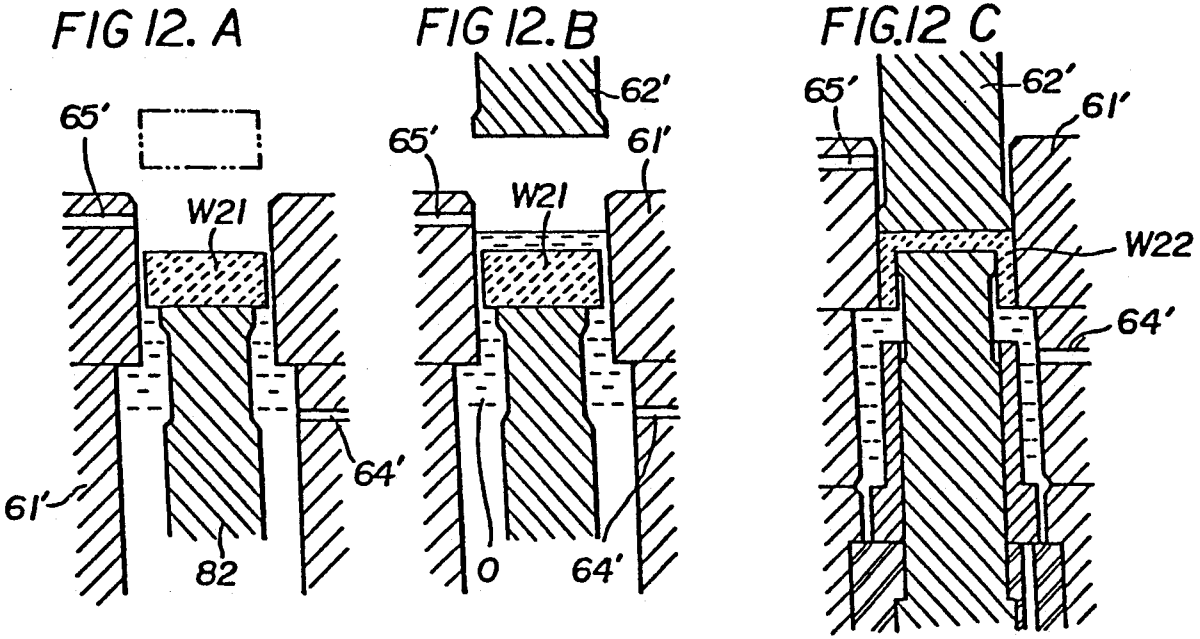
FIG 12. A
FIG 12. B
FIG. 12 C
65'
W21
64'
82
61'
62'
0
W22

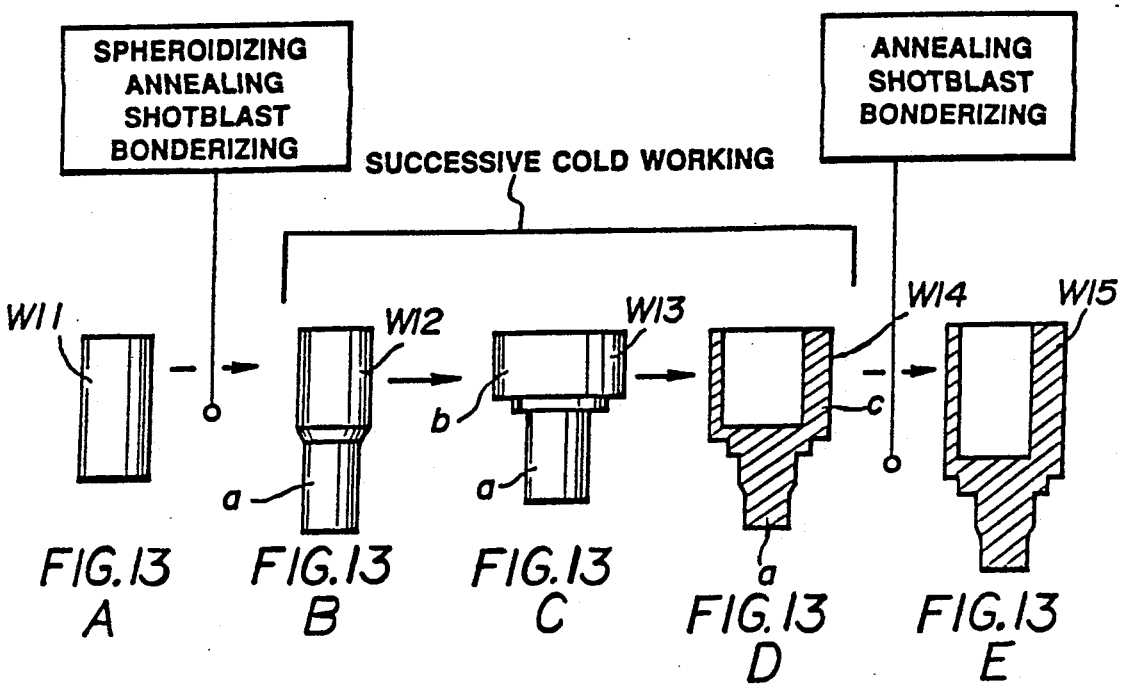
FIG.14
FIG.15
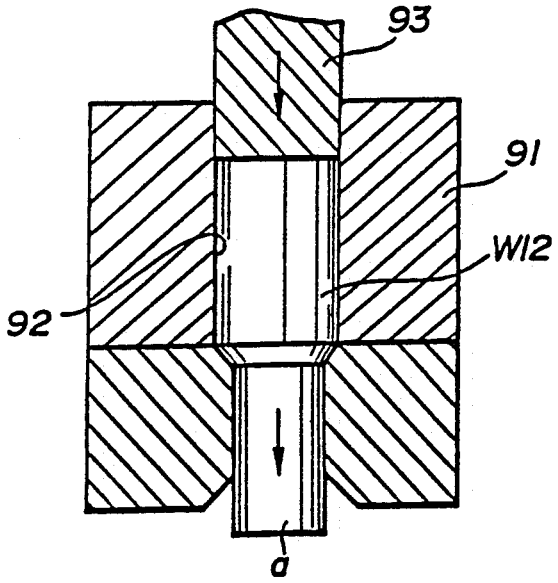
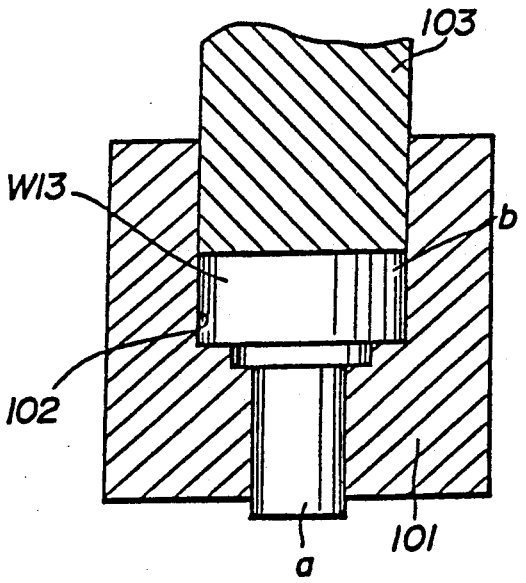

SUCCESSIVE COLD WORKING PROCESS

BACKGROUND OF THE INVENTION

1. Field of the Invention

The present invention relates to a successive cold working process for successively forging a billet below a transformation temperature (i.e., a recrystallization temperature) thereof.

2. Description of the Relevant Art

One conventional process for successively working a billet through a plurality of forging steps (pressing steps) is disclosed in Japanese Laid-Open Patent Publication No. 60-115343.

The disclosed process works the billet into an anchor bolt with a transfer press machine having a plurality of forging dies arranged side by side.

Japanese Laid-Open Patent Publication No. 59-220243 shows a cold forging process for forging a billet between a die and a punch below a transformation temperature of the billet.

The above prior methods however do not take into account the problems of lubrication and age hardening (work hardening).

When cold-forging a billet by extrusion or upsetting, galling would occur between the billet and a die unless a lubricating film were present on the surface of the billet. To prevent such galling, a film such as a phosphate coating is formed on the billet surface by bonderizing the billet as is well known in the art. Alternatively, lubricating oil is applied to the billet or the die in each forging step as disclosed in Japanese Laid-Open Utility Model Publication No. 55-60238.

The thickness of a chemically converted lubricating film on a bonderized billet is however largely reduced in a single forging step irrespective of the desired forging ratio, and therefore the lubricating film does not allow the billet to be forged in successive steps. Where the forging ratio is high, the lubricating effect of the film is lost by the heat produced when the billet is forged. Accordingly, use of such a bonderized coating is not suitable in a transfer successive forging process. The application of lubricating oil is disadvantageous in that it cannot be uniformly coated on the entire surfaces of the billet and the die, a large amount of lubricating oil is needed, and applied lubricating oil tends to be scattered out of the die, thus contaminating the working environment. The coated lubricating oil cannot be processed easily. Since the lubricating oil film is simply present on the billet surface unlike the chemically converted coating, the billet surface may lose such lubricating oil and cause galling if the forging pressure is increased.

According to another lubricating method disclosed in Japanese Laid-Open Patent Publication No. 59-150639, lubricating oil is supplied under pressure into a region below a billet from the bottom of a die while the billet is being forged under pressure. The disclosed method is however not appropriate for use in successive cold forging because the method is primarily aimed at achieving the effect of a double-acting press by applying a force to the lower surface of the billet in counteracting the pressure of a punch.

When a billet is forged below a transformation temperature (recrystallization temperature), the billet is subject to age hardening. The inventor has found that the age hardening manifests itself upon elapse of a certain period of time after the billet has been forged. In the conventional processes, a lubricating coating is formed on the billet surface prior to each forging step, and hence age hardening progresses while the lubricating coating is being formed. Consequently, a next forging step cannot be effected before the billet undergoes a high degree of age hardening. It has therefore been necessary to anneal the billet prior to each of the second and subsequent forging steps, which however results in a poor production efficiency.

Japanese Patent Publication No. 63-41665 discloses a cold forging process in which certain condition are selected for upsetting and rearward extrusion processes, and these upsetting and rearward extrusion processes are successively carried out within a very short period of time, thus omitting lubrication and intermediate annealing steps from between these upsetting and rearward extrusion processes. According to this prior art, however, various forging conditions such as a billet size, a billet shape, a forging ratio, a carbon equivalent, and the like are extremely limited.

SUMMARY OF THE INVENTION

According to the present invention, there is provided a method of successively cold working a billet, comprising the steps of: (a) forming a chemically converted lubricating coating on a surface of the billet; (b) forging the billet into an intermediate product at a temperature below a transformation temperature of the billet; (c) covering a surface of the intermediate product with lubricating oil in a die cavity in a die assembly; and (d) forging the intermediate product at a temperature below the transformation temperature before the intermediate product gains a predetermined hardness due to age hardening resulting from the forging step (b).

In one aspect of the present invention, the die cavity is filled with the lubricating oil, and the intermediate product is forced into the die cavity.

In another aspect, the intermediate product is placed in the die cavity, the lubricating oil is supplied from above the intermediate product, and the lubricating oil remains filled up to a position higher than an upper surface of the intermediate product while the intermediate product is being forged.

With the above arrangement, when forging the billet in successive cold forging steps, a lubricating coating is formed on the surface of the intermediate product in the die cavity and the intermediate product is forged substantially simultaneously, in the second and subsequent forging steps. Therefore, any lubricating process and annealing process which have heretofore been required prior to each forging step may be dispensed with, resulting in a large increase in operation efficiency and a reduction in time. According to the present invention, there are no limitations on various forging conditions such as a billet size, a billet shape, a forging ratio, a carbon equivalent, and the like.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 5 is a graph illustrating the relationship between time that has elapsed after a billet was forged, the temperature of the billet, and the hardness thereof;

FIGS. 6(A) through 6(E) are views showing how a billet changes its shape while it is being worked according to a second embodiment;

FIGS. 11(A) through 11(E) and FIGS. 12(A) through 12(C) are cross-sectional views showing the manner in which billets are worked according to modifications of the second embodiment;

FIGS. 13(A) through 13(E) are views showing the relationship between the intermediate products illustrated in FIGS. 6(A) through 6(D) and a working sequence;

FIGS. 14 and 15 are cross-sectional views of dies for producing the intermediate products W12, W13, respectively;

DETAILED DESCRIPTION OF THE PREFERRED EMBODIMENTS

Figure 1:
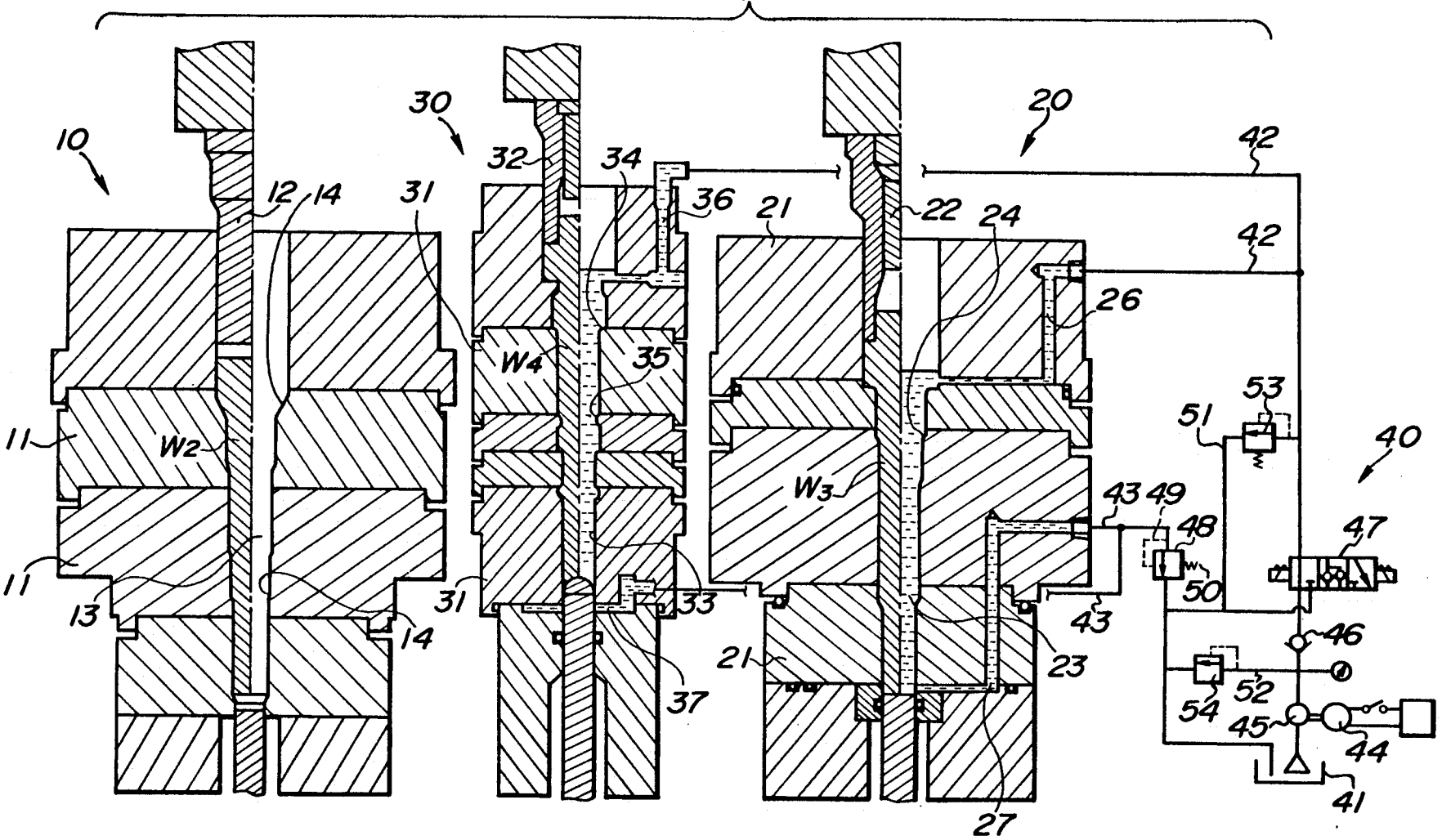
FIG. 1 is a cross-sectional view of a vertical forging pressing machine used for carrying out a method according to the present invention.

FIG. 1 shows a vertical forging press machine 1 for forging a billet in three successive forging steps. The press machine 1 has a die assembly 10 disposed on a lefthand side for effecting a first forging step, a die assembly 20 disposed on a righthand side for effecting a second forging step, and a die assembly 30 disposed in a central position for effecting a third forging step. A lubricating oil supply/discharge system 40 is disposed laterally of the die assembly 20/or supplying lubricating oil to and discharging lubricating oil from the die assemblies 20, 30.

The die assemblies 10, 20, 30 comprise a plurality of sets of dies 11, 21, 32 and punches 12, 22, 32, respectively, and have respective cavities 13, 23, 33 defined vertically therethrough by inner surfaces of the dies 11, 21, 31. The inner surfaces of the dies 11, 21, 31 have respective steps 14, 24, 34 for reducing the diameter of a billet to be forged. The inner surface of the die assembly 30 for effecting the final forging step has teeth 35 for forming splines on the billet.

The die assemblies 20, 30 have lubricating oil supply passages 26, 36 defined respectively in upper portions thereof and opening into upper regions of the cavities 23, 33. The die assemblies 20, 30 also have lubricating oil discharge passages 27, 37 defined respectively in intermediate and lower portions thereof and opening into the lower ends of the cavities 23, 33.

The lubricating oil supply/discharge system 40 has a supply pipe 42 connected to the supply passages 26, 36 and extending into a lubricating oil tank 41, and a discharge pipe 43 connected to the discharge passages 27, 37 and extending into the lubricating oil tank 41. Lubricating oil pumped from the lubricating oil tank 41 by a pump 45 driven by a motor 44 is fed via a check valve 46 and a solenoid-operated valve 47 into the supply passages 26, 36. The discharge pipe 43 interconnecting the lubricating oil tank 41 and the discharge passages 27, 37 has a relief valve 48. When an oil pressure is applied via a bypass passage 49 to the relief valve 48, the relief valve 48 is shifted to the right (FIG. 1) against the bias of a spring 50 to open a flow passage through the relief valve 48. When the oil pressure applied via the bypass passage 49 is lowered, the relief valve 48 is moved back by the resiliency of the spring 50 to close the flow passage therethrough.

The supply pipe 42 and the discharge pipe 43 are interconnected by branch pipes 51, 52 which have respective relief valves 53, 54. When the oil pressure in the supply pipe 42 exceeds a predetermined level, lubricating oil is released from the supply pipe 42 into the discharge pipe 43 through these relief valves 53, 54.

Lubricating oil which is used in the present invention may be ordinary lubricating oil such as header oil, but should preferably be thermally reactive lubricating oil which, when heated, forms a solid lubricating coating on the surface of a billet. Such thermally reactive lubricating oil may be produced by adding, to naphthenic base oil, 15.0 wt % to 25.0 wt % of a calcium additive, an active or inactive sulfurized oil (containing 4.0 wt % to 7.0 wt % of sulfur), and, where necessary, 1.0 wt % to 5.0 wt % of fine powder of a nontransition metal such as Cu, Zn, or the like, which has a particle diameter of 100 μm or less, and 2.0 wt % to 30 wt % % of chlorinated paraffin.

Figure 3:
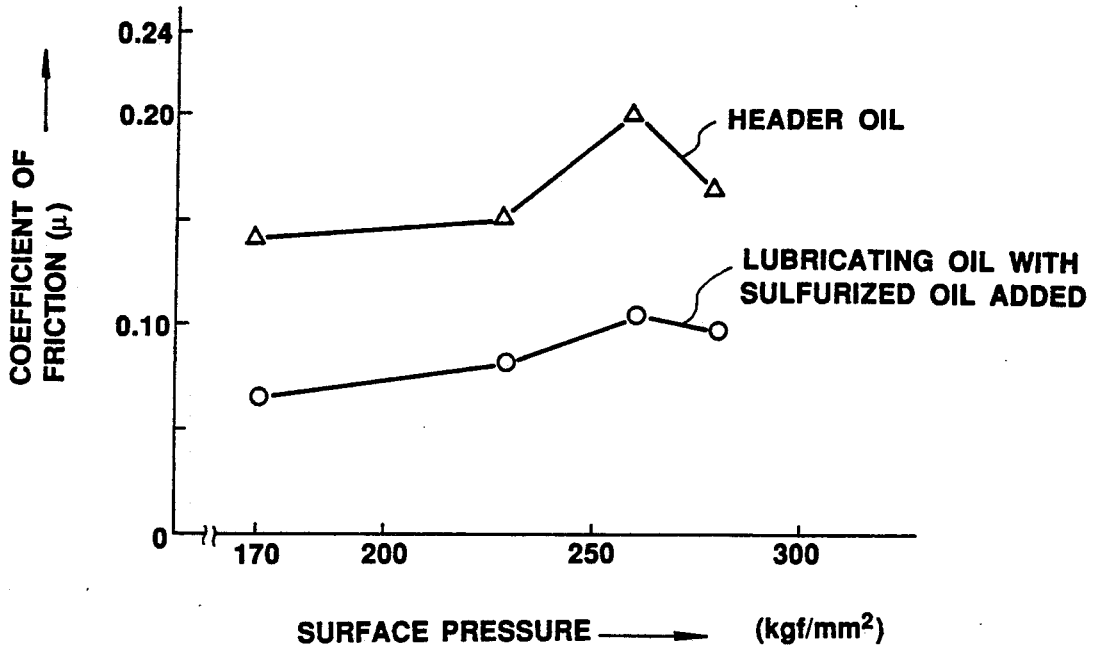
FIG. 3 is a graph showing the relationship between a surface pressure and a coefficient of friction.
Figure 4:
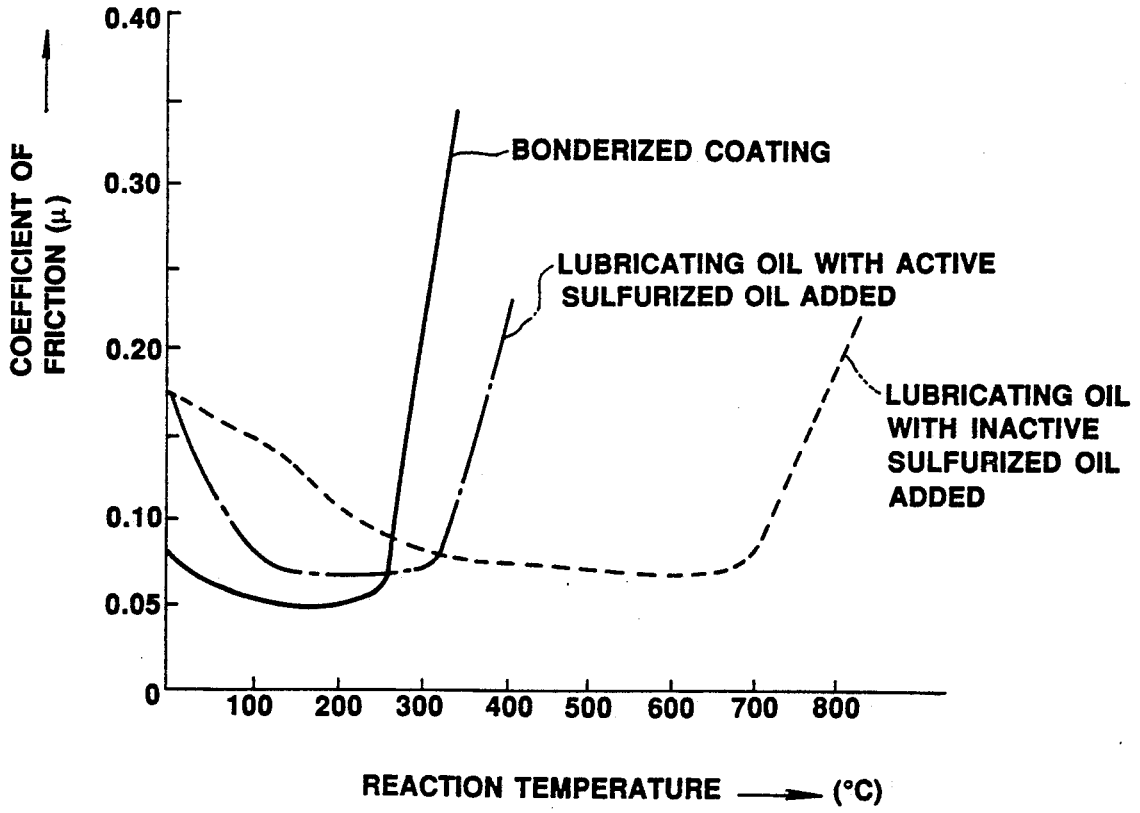
FIG. 4 is a graph showing the relationship between a temperature and a coefficient of friction.

The lubricating oil is made of the aforesaid constituents for the following reasons:

The active or inactive sulfurized oil does not react under ordinary conditions. However, after an oil film formed of an oiliness agent on a billet has been broken, i.e., when the temperature of the billet is increased due to frictional heat and forging heat, the active or inactive sulfurized oil is chemically decomposed to produce iron sulfide in reaction with the die and the billet, thus producing a highly pressure-resistant solid lubricating coating on the surfaces of the die and the billet as shown in FIG. 3. As illustrated in FIG. 4, the active sulfurized oil and the inactive sulfurized oil are used in different temperature ranges, i.e., the range of from 150° to 300° C. and the range of from 250° to 400° C., respectively, and hence should be used separately dependent on the forging ratio or the like.

With the calcium additive (in the form of fine powder with a particle diameter of 1 μm or less) added, the lubricating film can be retained well and a longer time is required for the coefficient of friction of the lubricating coating to increase. Use of the naphthenic base oil is advantageous in that the additives can be dissolved therein more easily than when they are dissolved in paraffinic base oil. The addition of the nontransition metal powder of CU, Zn, or the like improves the wear resistance of the lubricating coating.

A successive cold working process for producing a countershaft using the vertical forging press machine will be described below.

Figure 2D:
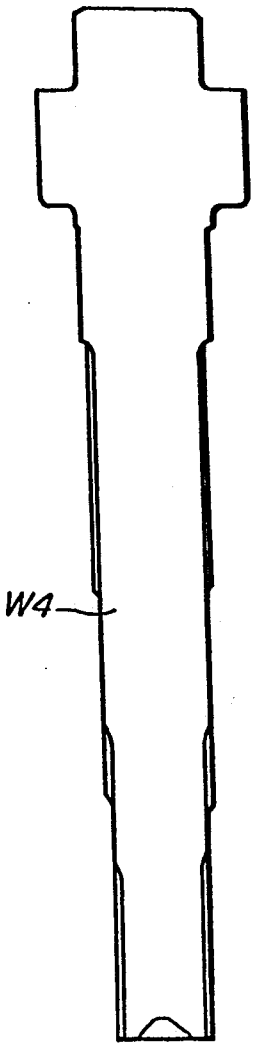
FIGS. 2(A) through 2(D) are views showing how a billet changes its shape while it is being worked into a product.
Figure 2C:
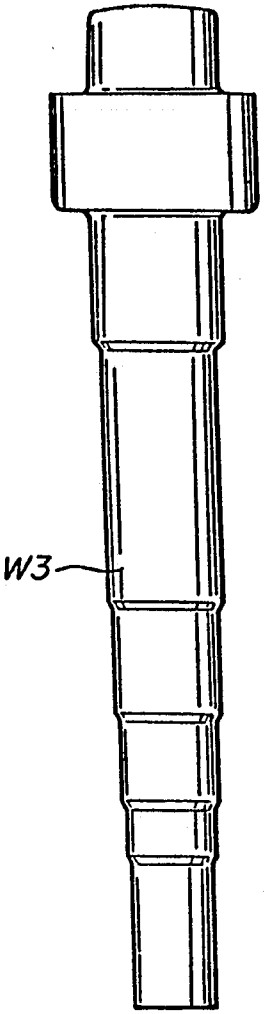
Figure 2B:
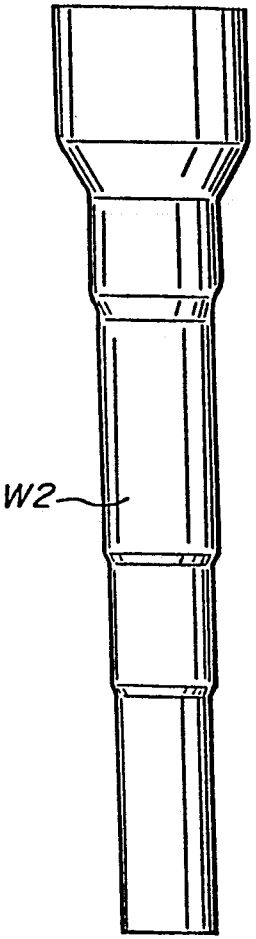
Figure 2A:
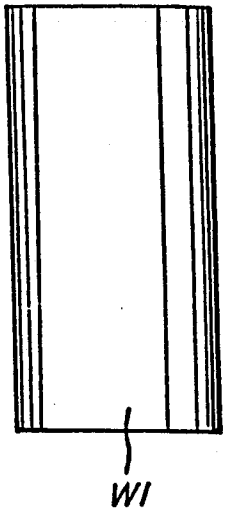

A billet W1 as a workpiece to be worked into a countershaft is prepared as shown in FIG. 2(A). The surface of the billet W1 is bonderized in advance to form a chemically converted coating such as a phosphate coating thereon.

The billet W1 is then set in the cavity 13 in the die assembly 10 shown in FIG. 1, and forged by a punch 12 pressed downwardly to produce an intermediate product or blank W2 shown in FIG. 2(B).

Then, the intermediate product W2 is ejected from the die assembly 10, and placed in the cavity 23 in the die assembly 20. The intermediate product W2 should be forged by the die assembly 20 before it starts undergoing age hardening after it has been forged by the die assembly 10. Specifically, since the hardness of the billet after it has been forged reaches HRB 85 in 18 seconds, as shown in FIG. 5, it is preferable that die assembly 20 start forging the intermediate product W2 within 18 seconds.

Before forging the intermediate product W2 in the die assembly 20, the solenoid-operated valve 47 is opened and the pump 45 is operated to fill the lubricating oil in the cavity 23 through the supply pipe 42 and the supply passage 26 as illustrated in FIG. 1. Then, the intermediate product W2 which has been drawn to some extent by the die assembly 10 is placed in the cavity 23. Since the intermediate product W2 has been heated up to 200° C. or higher by the previous forging step, when the intermediate product W2 is immersed in the lubricating oil in the cavity 23, the lubricating oil reacts to form a solid lubricating coating on the forged surface of the intermediate product W2. Immediately thereafter, the intermediate produce W2 is pressed into the cavity 23 by a punch 22 to form a drawn intermediate produce W3 as shown in FIG. 2(C).

During the forging step in the die assembly 20, the lubricating oil in the cavity 23 is enclosed in the cavity 23 since the upper end of the cavity 23 is closed by the larger-diameter portion of the intermediate product W2. As the intermediate product W2 is moved downwardly by the punch 22, the pressure of the lubricating oil in the cavity 23 rises. When the pressure of the lubricating oil in the cavity 23 exceeds a certain level, the relief valve 48 is opened to discharge the lubricating oil from the cavity 23 via the discharge passage 27 and the discharge pipe 43 into the tank 41 while maintaining the oil pressure at a constant level in the cavity 23.

Inasmuch as the lubricating oil is confined in the cavity 23 during the forging step until the pressure thereof exceeds the predetermined level, the lubricating oil goes sufficiently all over the intermediate product W2 due to a hydrostatic effect.

After the forging step in the die assembly 20, the die assembly 30 starts forging the intermediate product W3 before any age hardening thereof manifests itself. The die assembly 30 forges the intermediate product W3 to draw itself and form splines thereon, thus producing a countershaft W4 as shown in FIG. 2(D).

While the countershaft is formed in the above embodiment, an outer race for a constant-velocity joint may be manufactured in a forging process as shown in FIGS. 6(A) through 6(E) according to the present invention.

Figure 7:
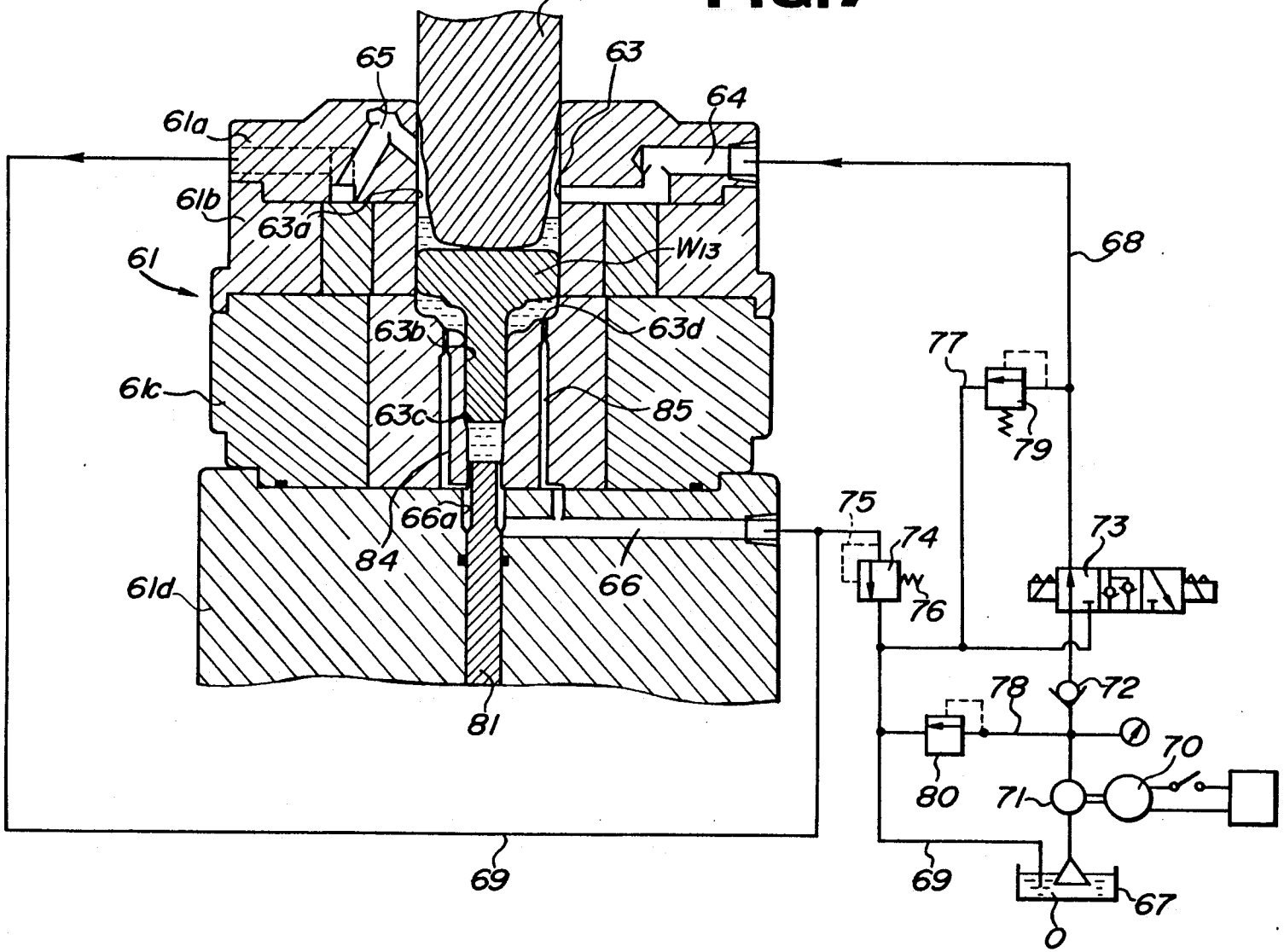
FIG. 7 is a cross-sectional view of an extrusion apparatus for producing an intermediate product W14 shown in FIG. 6(D) from an intermediate product W13 shown in FIG. 6(C)

FIG. 7 shows an extrusion apparatus for producing an intermediate product W14 shown in FIG. 6(D) from an intermediate product W13 shown in FIG. 6(C). The extrusion apparatus comprises a die assembly 61 having a plurality of separate dies **61*a*, 61*b*, 61*c*, 61*d* and a punch 62, the die assembly 61 having a forging cavity 63** opening upwardly.

The cavity 63 has an upper larger-diameter hole **63*a* for forming a cup-shaped portion and a lower smaller-diameter hole 63*b* for forming a stepped shank portion, the smaller-diameter hole 63*b* having a drawing step 63*c* in its vertically intermediate position. A supply passage 64 defined in the upper die 61*a* for supplying lubricating oil O has an end opening at an inner surface of the larger-diameter hole 63*a*, and an overflow discharge passage 65 defined in the upper die 61*a* also has an end opening at the inner surface of the larger-diameter hole 63*a*. An ejector pin 81 for ejecting a forged product from the die assembly 61 has an upper end disposed at the bottom of the smaller-diameter hole 63*b*. The lower die 61*d* has an annular recess 66*a* defined therein around the ejector pin 81 and held in communication with the smaller-diameter hole 63*b*. A discharge passage 66 defined in the lower die 61*d* has an end opening into the recess 66*a***.

Figure 8:
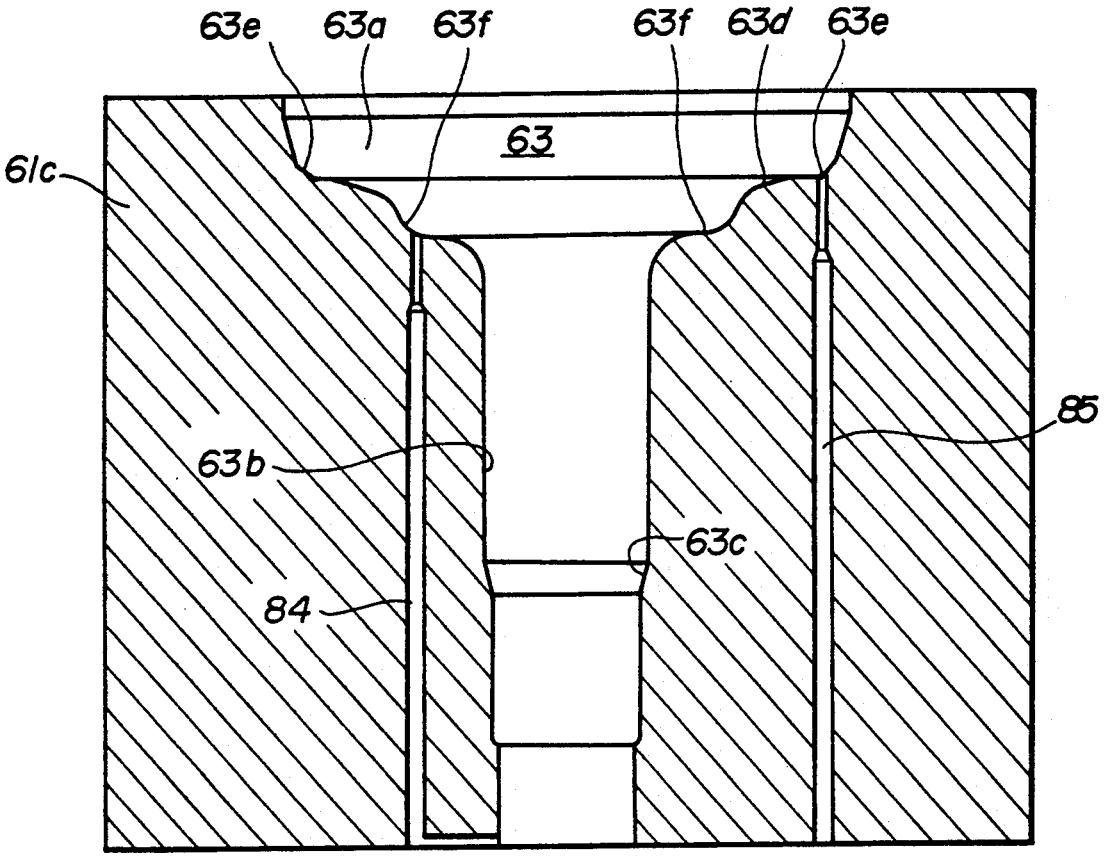
FIG. 8 is an enlarged cross-sectional view of an intermediate die in the extrusion apparatus of FIG. 7.

As also shown in FIG. 8, the cavity 63 has a step **63*d* at a lower surface of the larger-diameter hole 63*a*. The cavity 63 also has an annular corner 63*e* at the lower end thereof. The cavity 63 also has an annular corner 63*f* disposed below the step 63*d*. Since lubricating oil tends to be confined between the inner cavity surface and the billet at the corners 63*e*, 63*f*, two different groups of relief holes 84, 85 defined vertically through the die 61*c* have upper ends opening at these corners 63*e*, 63*f***, respectively.

Figure 9:
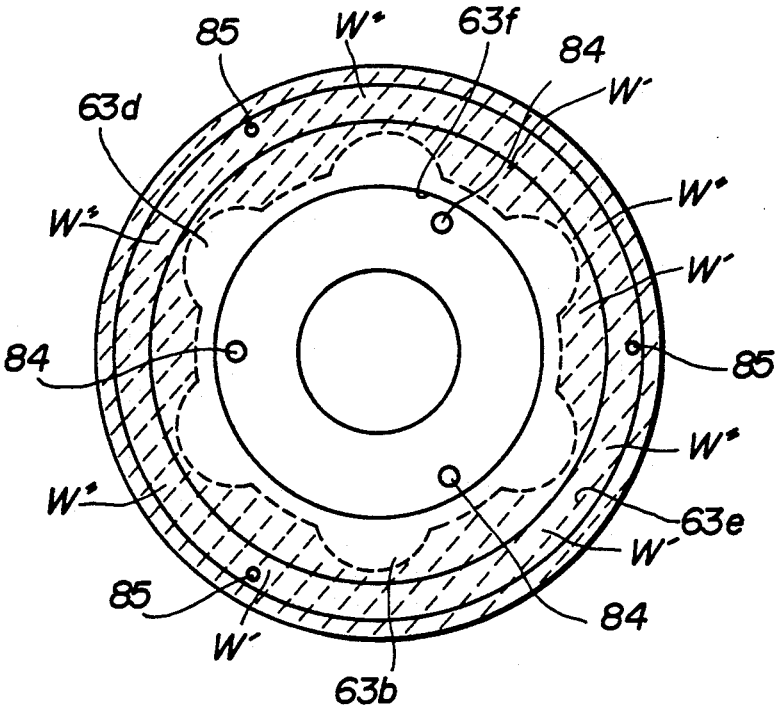
FIG. 9 is a plan view of a cavity in the die of FIG. 8.

Each of the relief holes 84, 85 has a diameter ranging from 0.5 mm to 2.0 mm. As shown in FIG. 9, there are three 120°-spaced relief holes 84 and three 120°-spaced relief holes 85, the relief holes 84, 85 being used as relief holes when an outer race for a constant-velocity joint is formed.

As shown in FIG. 9, the relief holes 84, 85 open in areas which positionally correspond to thicker portions W' of the billet as indicated by the broken line. If the relief holes 84, 85 opened in areas positionally corresponding to thinner portions W" of the billet, since the thicker portions W" are strongly pressed against the inner surface of the die cavity when the billet is forged, the billet would develop burrs at such relief holes.

A lubricating oil tank 67 is disposed remotely from the die assembly 61 and is connected to the supply passage 64 by a supply pipe 68 and to the discharge passages 65, 66 by a discharge pipe 69. Lubricating oil O pumped from the lubricating oil tank 67 by a pump 71 driven by a motor 70 is fed via a check valve 72 and a solenoid-operated valve 73 into the supply pipe 68. The discharge pipe 69 has a relief valve 74. When an oil pressure is applied via a bypass passage 75 to the relief valve 74, the relief valve 74 is shifted to the right (FIG. 7) against the bias of a spring 76 to open a flow passage through the relief valve 74. When the oil pressure applied via the bypass passage 75 is lowered, the relief valve 74 is moved back by the resiliency of the spring 76 to close the flow passage therethrough.

The supply pipe 68 and the discharge pipe 69 are interconnected by branch pipes 77, 78 which have respective relief valves 79, 80. When the oil pressure in the supply pipe 68 exceeds a predetermined level, lubricating oil is released from the supply pipe 68 into the discharge pipe 69 through these relief valves 79, 80.

A process of extruding a cup-shaped component such as an outer race for a constant-velocity joint from a billet, using the extrusion apparatus shown in FIGS. 7 through 9, will be described with references to FIGS. 10(A) through 10(E).

Figures 10A, 10B, 10C, 10D, 10E:
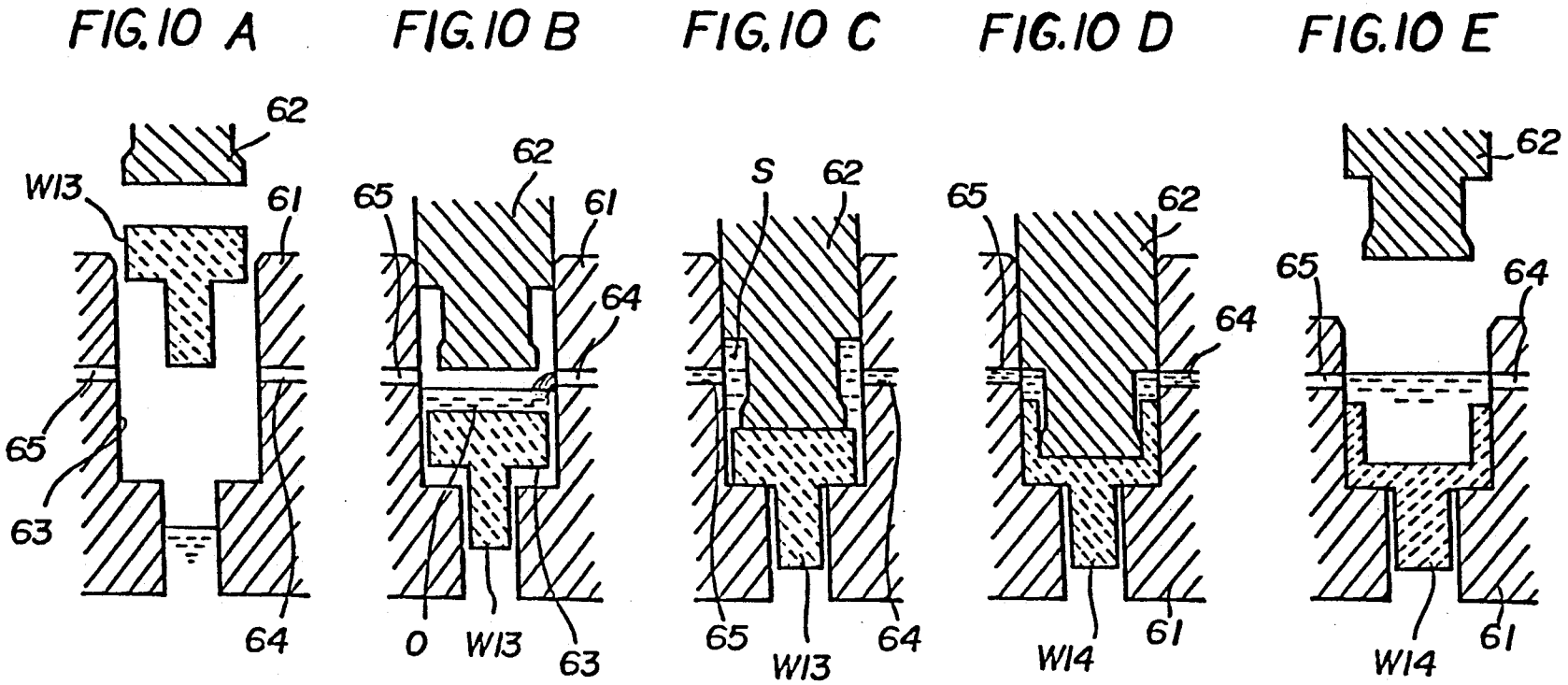
FIGS. 10(A) through 10(E) are cross-sectional views showing the manner in which a billet is worked according to the second embodiment.

A billet or workpiece W13 is placed in the cavity 63 in the die assembly 61 as shown in FIG. 10(A). The billet W13 has been produced by upsetting one end of the intermediate product W12, and has been heated to a temperature ranging from 150° C. to 400° C. in such an upsetting process. A small amount of lubricating oil O remains in the cavity 63.

Then, as illustrated in FIG. 10(B), additional lubricating oil O is supplied from the supply passage 64 into the cavity 63 to a level higher than the upper end of the billet 13.

Thereafter, a punch 62 is lowered until it abuts against the upper end of the billet W13 as shown in FIG. 10(C). The punch 62 is further lowered to extrude the billet W13 backwards to form a cup-shaped intermediate product W14 as shown in FIG. 10(D), and then the punch 62 is lifted as shown in FIG. 10(E), after which the cup-shaped intermediate product W14 is ejected from the die assembly 61 by the ejector pin 81.

In the above embodiment, during the forging step shown in FIGS. 10(C) and 10(D), the lubricating oil O trapped in a space S in the cavity 63 which is defined between the billet W13 and the punch 62 is subjected to a constant pressure at all times by the relief valve 74 in the discharge pipe 69. As a result, the lubricating oil O is spread all over the surface of the billet W13, thus preventing galling from occurring.

FIGS. 11(A) through 11(E) and FIGS. 12(A) through 12(C) illustrate working processes according to modification of the embodiment shown in FIG. 10. FIGS. 11(A) through 11(E) correspond respectively to FIGS. 10(A) through 10(E). In this modification, a cup-shaped product with no shank is extruded backwards. Since the starting billet used in this modification is not subjected to upsetting, it has to be heated by some means if thermally reactive lubricating oil is to be used.

FIGS. 12(A) through 12(C) show a forward extrusion process. As illustrated in FIG. 12(A), a billet W21 is set on a fixed punch 82 in a die assembly 61'. Then, lubricating oil O is supplied up to a level higher than the upper end of the billet W21 from a supply passage 64' as shown in FIG. 12(B), after which a movable punch 62' is pressed downwardly to extrude the billet W21 into a desired product as shown in FIG. 12(C).

FIGS. 13(A) through 13(E) illustrate the relationship between the respective intermediate products shown in FIGS. 6(A) through 6(E) and the working process. The surface of a cylindrical billet W11 shown in FIG. 13(A) is bonderized to form a lubricating coating such as a phosphate coating thereon. Then, the billet W1 is set in a cavity 92 in a die assembly 91 shown in FIG. 14 and extruded forwardly by a punch 93 to produce an intermediate product W12 having a shank a as shown in FIG. 13(B). The shank a has a principal logarithmic strain (the degree of deformation) of about 1.26 as can be seen from the following Table:

TABLE

| Step | | A → B | B → C | C → D | Annealing | D → E |
|---|---|---|---|---|---|---|
| Principal logarithmic strain | Head | 0 | 0.31 | 0.59 | 0 | 0.1 |
| | Shank | 1.26 | 0 | 0.2 | | 0 |
| Total principal logarithmic strain | Head | 0 | 0.31 | 0.9 | 0 | 0.1 |
| | Shank | 1.26 | 1.26 | 1.46 | | 0 |

The alphabetical letters A, B, C, D in Table above correspond to FIGS. 6(A) through 6(D), respectively. The principal logarithmic strain $\phi_1$ in the forward extrusion and the principal logarithmic strain $\phi_2$ in the backward extrusion are calculated according to the following equations:

$$\phi_1 = \ln \frac{A_0}{A_1}$$

where $A_0$: the cross-sectional area of the billet before it is extruded; and $A_1$: the cross-sectional area of the billet after it is extruded.

$$\phi_2 = \ln \frac{d_0}{d_0 - d_1} - 1.6$$

where $d_0$: the diameter of the billet before it is extruded; and $d_1$: the diameter of the billet after it is extruded.

After the intermediate product W12 having the shank a has been produced, it is set in a cavity 102 in a die assembly 101 illustrated in FIG. 15, and upset by a punch 103 to produce an intermediate product W13 having a shank a and a had b as shown in FIG. 13(C). When forging the intermediate product W13 from the intermediate product W12, no lubricating oil is supplied since the lubricating coating formed on the surface of the cylindrical billet W11 still remains on the intermediate product W12. The strain of the product thus forged at this time is about $\ln\phi g=0.31$.

The intermediate product W13 thus produced is then placed in the cavity 63 in the die assembly 61 shown in FIG. 7, the lubricating oil O is supplied into the cavity 63 via the supply passage 64 until the cavity 63 is filled up with the lubricating oil O, and the punch 62 is lowered to extrude the head b of the intermediate product W13 backwards as shown in FIG. 10(D) to produce the intermediate product W14 having a cup-shaped portion c as shown in FIG. 13(D), all before the intermediate product W13 gains a predetermined hardness due to age hardening, specifically within 5 minutes, or preferably within 18 seconds. The strain of the cup-shaped portion c is $\ln\phi g=0.59$ caused by the backward extrusion process only, but $\ln\phi g=0.9$ caused by the backward extrusion and previous upsetting process in the continuous cold working.

Figure 16A:
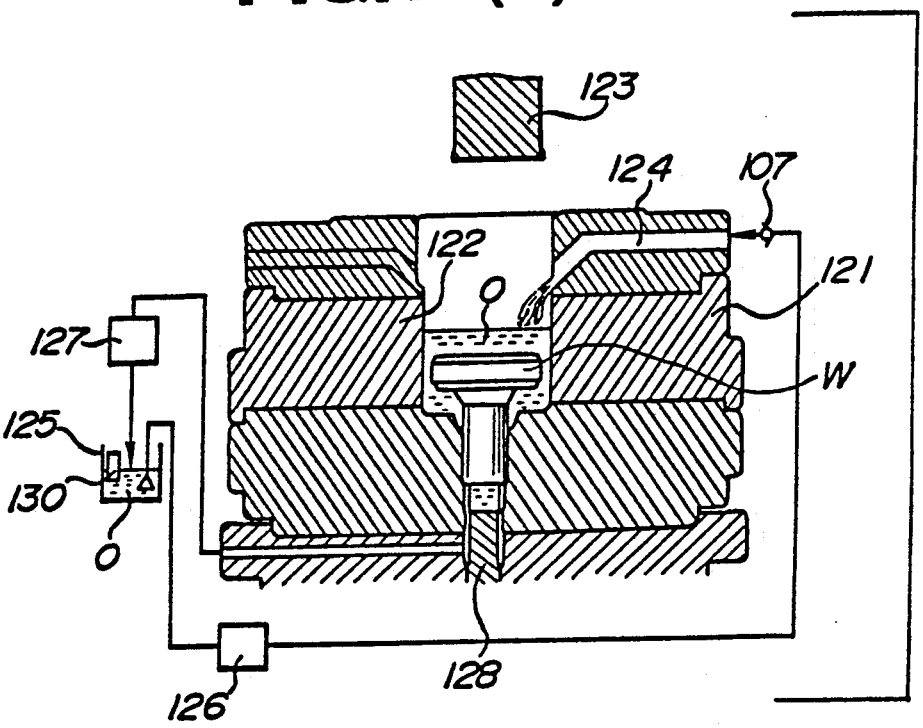
FIGS. 16(A) and 16(B) are cross-sectional views of a modified working apparatus.
Figure 16B:
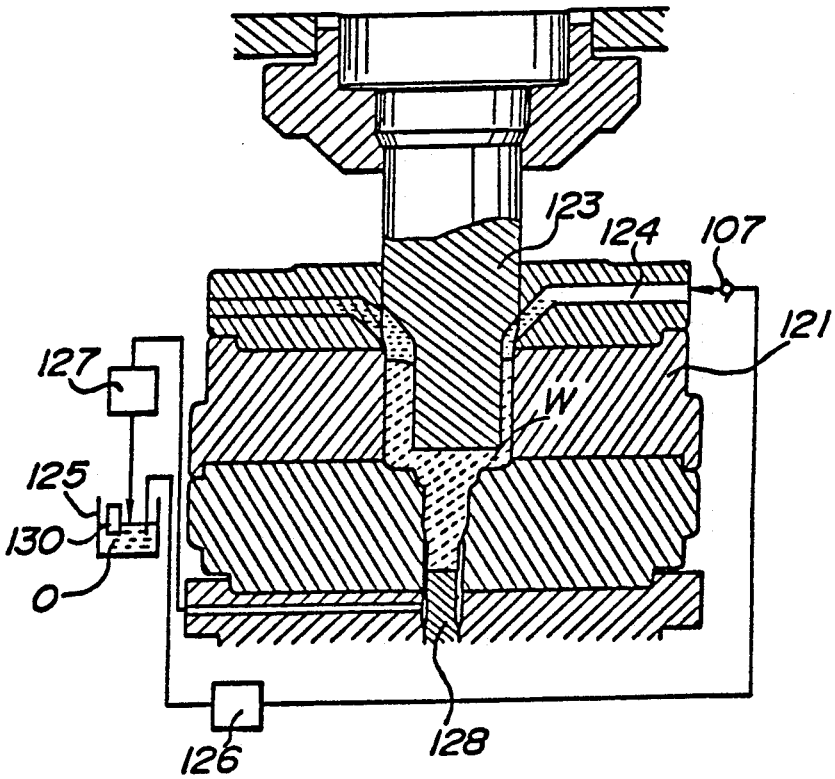

FIGS. 16(A) and 16(B) show a modified working apparatus. Lubricating oil O is pumped from a tank 125 and stored in a constant-quantity supply device 126, from which the lubricating oil O is instantaneously supplied to a cavity 122 (FIG. 16(A)). Note that the lubricating oil supply and discharge system for this apparatus is shown more particularly in FIG. 25. After a billet has been forged, the lubricating oil O is discharged from around an ejector pin 128 into the tank 125 by a discharge device 127 (FIG. 16 (B)). Therefore, the lubricating oil O is circulated between the tank 125 and the cavity 122. The tank 125 has a temperature control device 130 including a cooler and a heater for selectively cooling and heating the lubricating oil O in the tank 125 to keep the temperature of the lubricating oil, the temperature of a die assembly 121, and the temperature of a billet or workpiece W in certain ranges.

Figure 17:
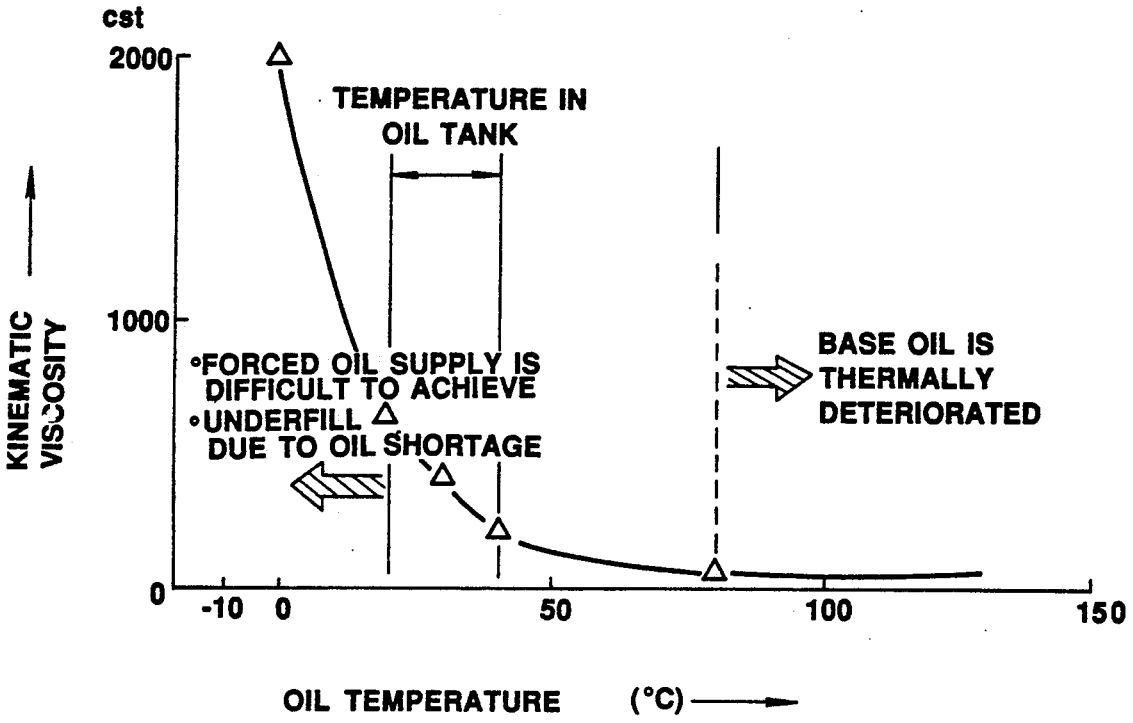
FIG. 17 is a graph showing the relationship between the temperature and kinematic viscosity of lubricating oil.
Figure 18:
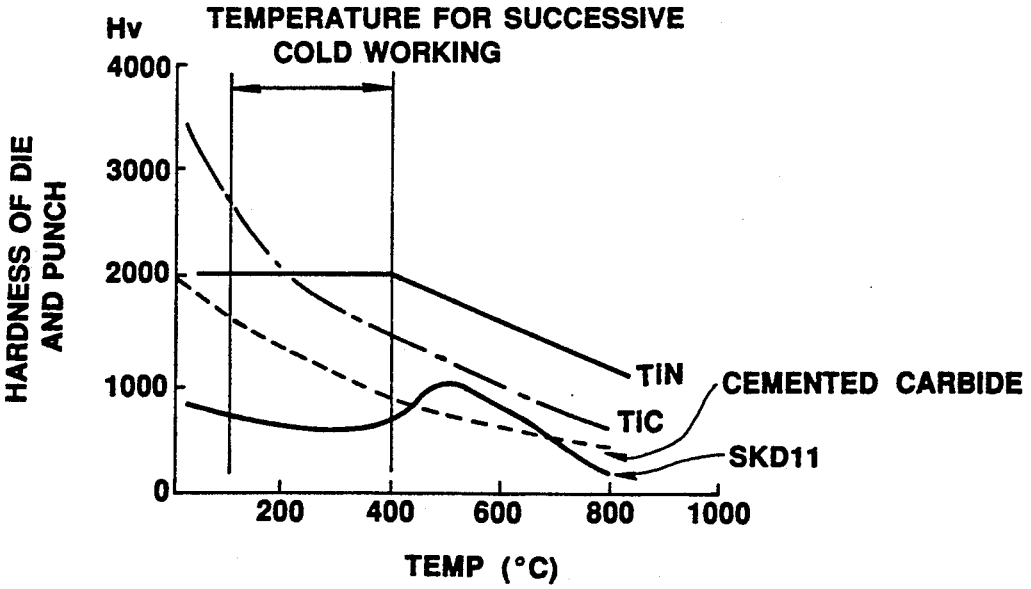
FIG. 18 is a graph showing the relationship between the temperature and hardness of a punch.

As shown in FIG. 17, if the temperature of the lubricating oil O in the tank 125 dropped below 20° C., the kinematic viscosity of the temperature oil O would be too high to be forcibly supplied from the tank 125, and if the temperature of the lubricating oil O in the tank 125 increased beyond 40° C., the lubricating oil O would be deteriorated by heat. Accordingly, the lubricating oil O in the tank 125 should preferably be kept in a temperature range of from 20° C. to 40° C. The die assembly 121 and a punch 123 should preferably be cooled by the lubricating oil O so that they are maintained in a temperature range of from 100° C. to 400° C. in which a surface coating of TiN or the like thereon is not deteriorated as shown in FIG. 18.

Figure 19:
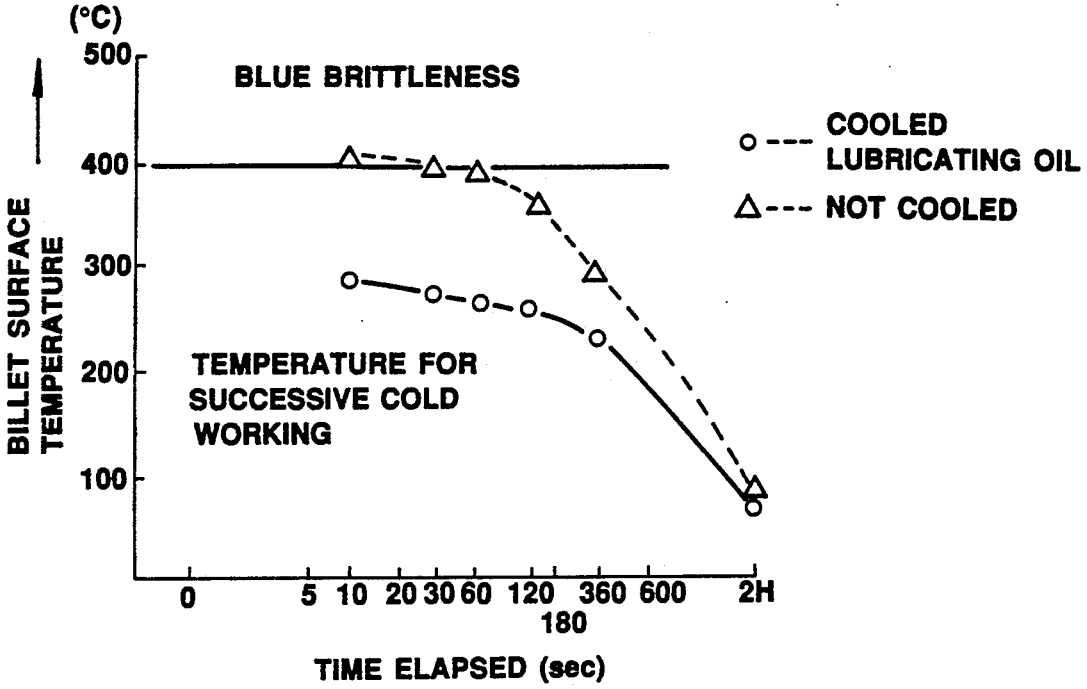
FIG. 19 is a graph showing the relationship between the surface hardness of a billet and time that has elapsed after the billet was worked.
Figure 20:
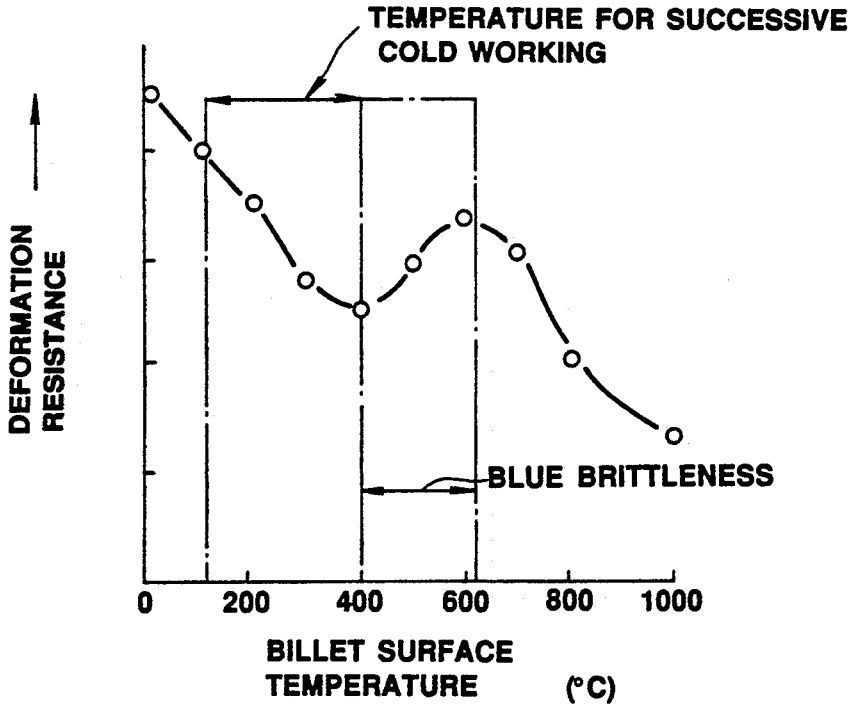
FIG. 20 is a graph showing the relationship between the surface temperature and deformation resistance of a billet.
Figure 21:
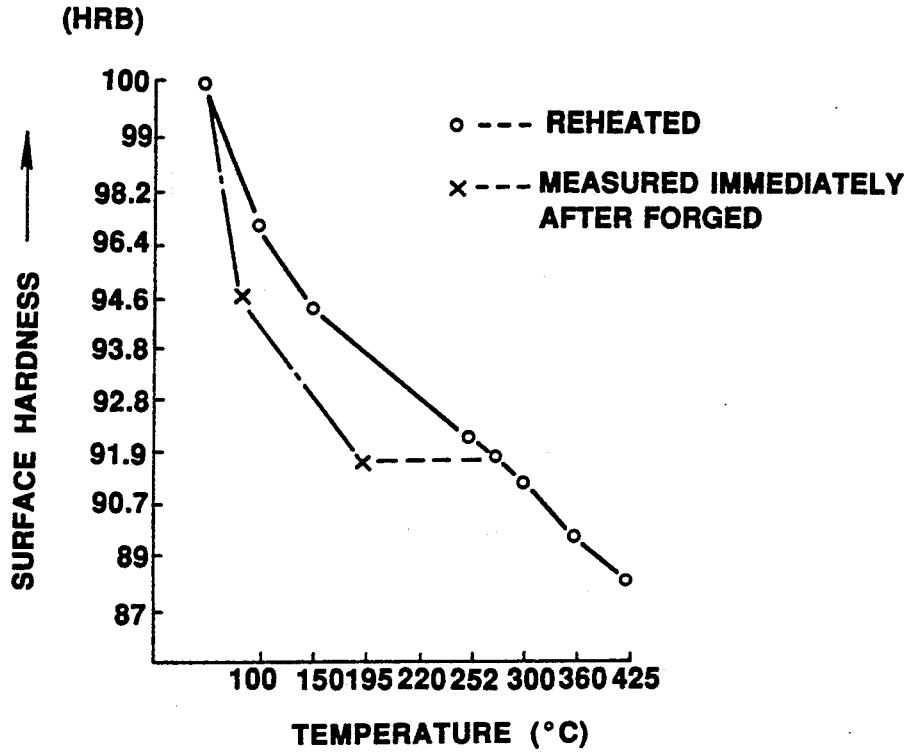
FIG. 21 is a graph showing the relationship between the surface temperature and surface hardness of a billet.

FIG. 19 is a graph showing the relationship between the surface hardness of a billet and time which has elapsed after the billet was worked, the graph indicating curves plotted when the billet is cooled and not cooled by lubricating oil. FIG. 20 is a graph showing the relationship between the surface temperature and deformation resistance of a billet. In view of these graphs, the billet is cooled by lubricating oil so that it is kept in a temperature range of from 100° C. to 400° C. in which the billet is not subjected to blue brittleness, while the billet is being forged, and preferably it is kept in a temperature range of from 150° C. to 300° C. when the billet as forged into cup-shaped product is ejected from a die assembly. According to the present invention, unlike the invention disclosed in Japanese Patent Publication No. 63-41665, the heat generated during a forging process is suppressed by the presence of lubricating oil to keep the billet in an optimum temperature range, and emphasis is put on an age hardening time, as can be understood from FIG. 21. FIG. 21 shows the relationship between the surface temperature and hardness of a billet, and indicates that a billet which has been subjected to age hardening is harder than a billet which has the same temperature as that of the age-hardened billet but has not been subjected to age hardening.

The intermediate product W14 thus produced is placed in another ironing die assembly having a different cavity before it gains a predetermined hardness due to age hardening, and then the intermediate product W14 is ironed to form a cup-shaped product W15 with a shank as shown in FIG. 13(E).

Figure 22:
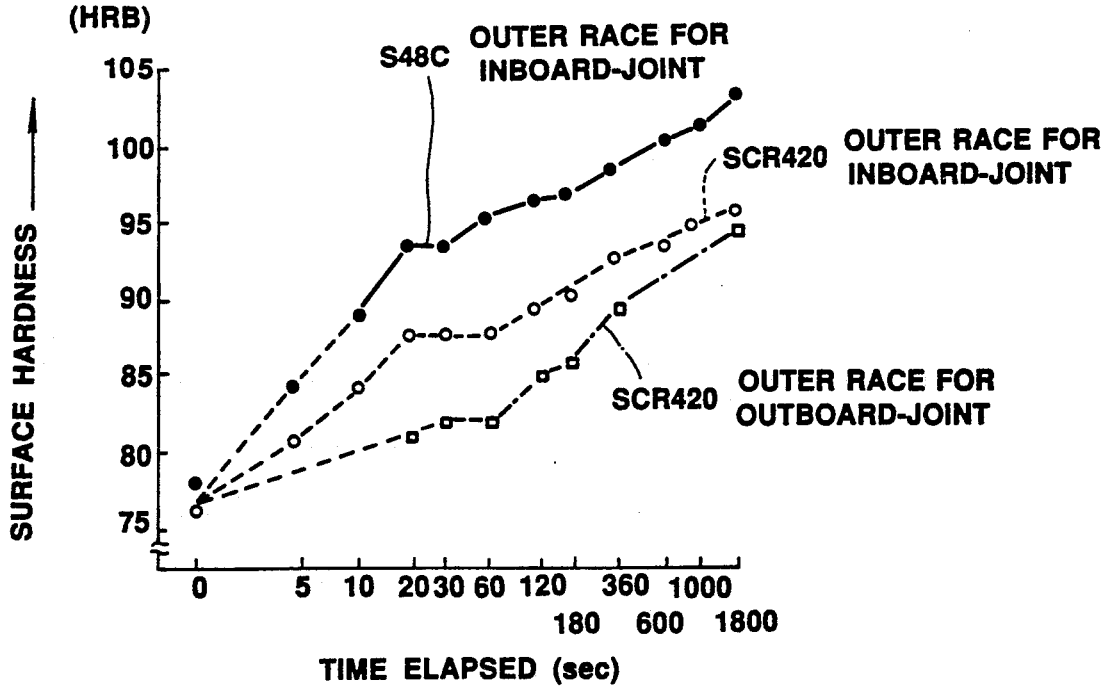
FIG. 22 is a graph showing the relationship between the surface hardness of a product and tie that has elapsed after the produced was formed.
Figure 23:
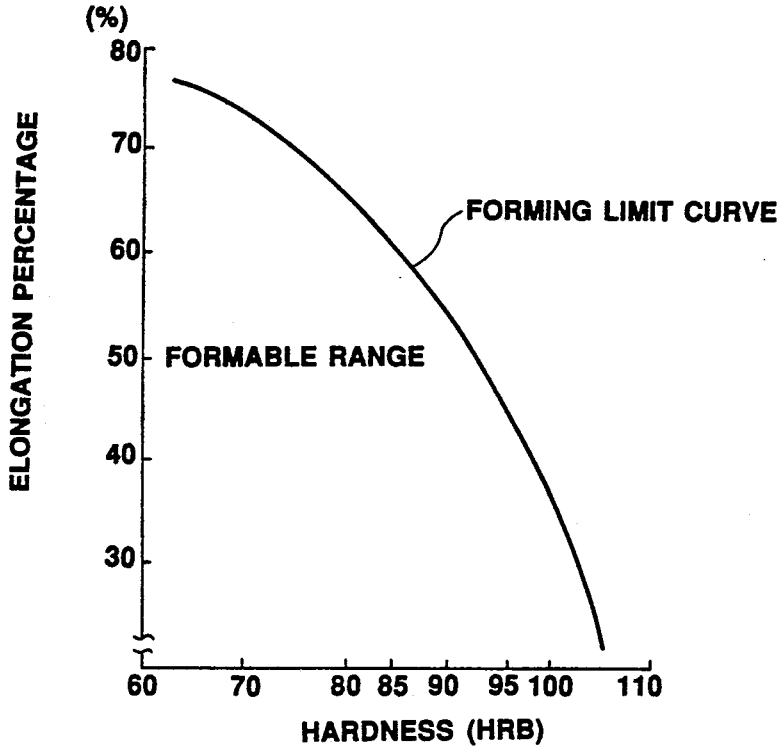
FIG. 23 is a graph showing the relationship between the surface hardness and elongation percentage of a billet.

In the above embodiment, a cold working transfer press with a pressing capacity ranging from 1600 tons to 2500 tons is used, and forges billets at time intervals ranging from 3 to 4 sec. (the production rate ranges from 15 to 20 spm). However, the cold working transfer press may forge billets at time intervals within 5 minutes. FIG. 22 is a graph showing the relationship between the surface hardness of a product and time that has elapsed after the product was formed. FIG. 22 indicates that age hardening curves are different dependent on the material of the product and the forging ratio )product shape). FIG. 23 is a graph showing the relationship between the surface hardness and elongation percentage of a billet. A forming limit curve can be drawn based on the graph of FIG. 23. Accordingly, the relationship between an age hardening time governed by the material of a billet and the hardness thereof is measured, and a forming limit can be determined from the elongation of the billet corresponding to the measured relationship and a forming load applied to the billet.

Figure 24:
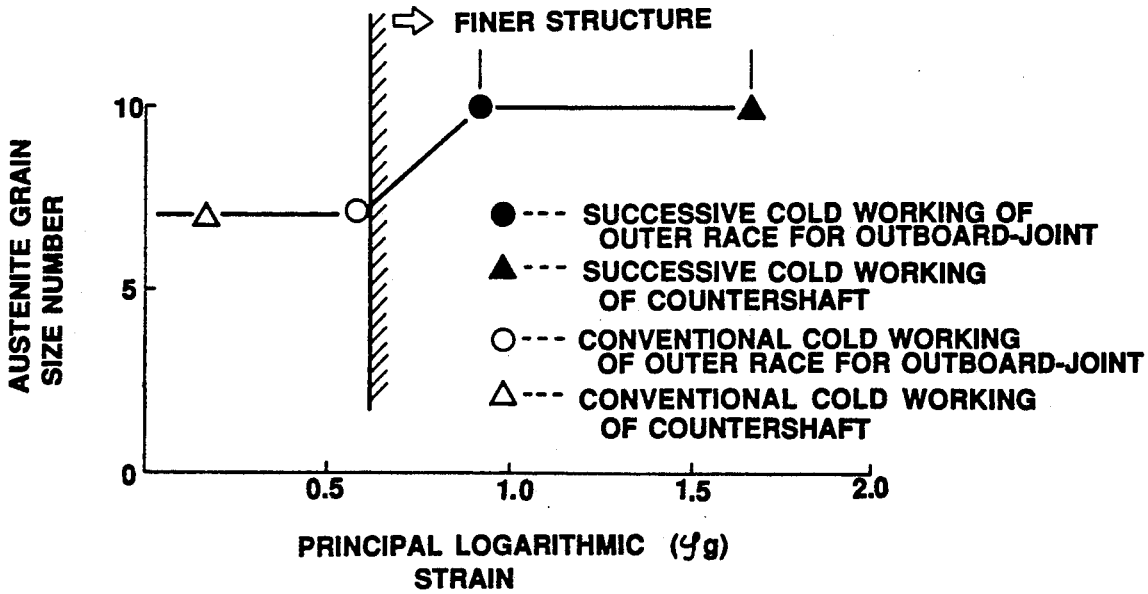
FIG. 24 is a graph showing the relationship between principal logarithmic strain and grain size number.

The billet used in the embodiment may be of either carburized hardened steel or induction hardened steel. The total strain of each of the shank and cup-shaped portion of the product due to ironing and successive forging prior to annealing may be $\ln\phi g=0.6$ or higher. FIG. 24 is a graph showing the relationship between the principal logarithmic strain ($\ln\phi g$) and the grain size number, and indicates that the principal logarithmic strain can be 0.6 or higher by employing a successive cold working process, and the product can have a tight structure with the principal logarithmic strain of 0.6 or higher.

Figure 25:
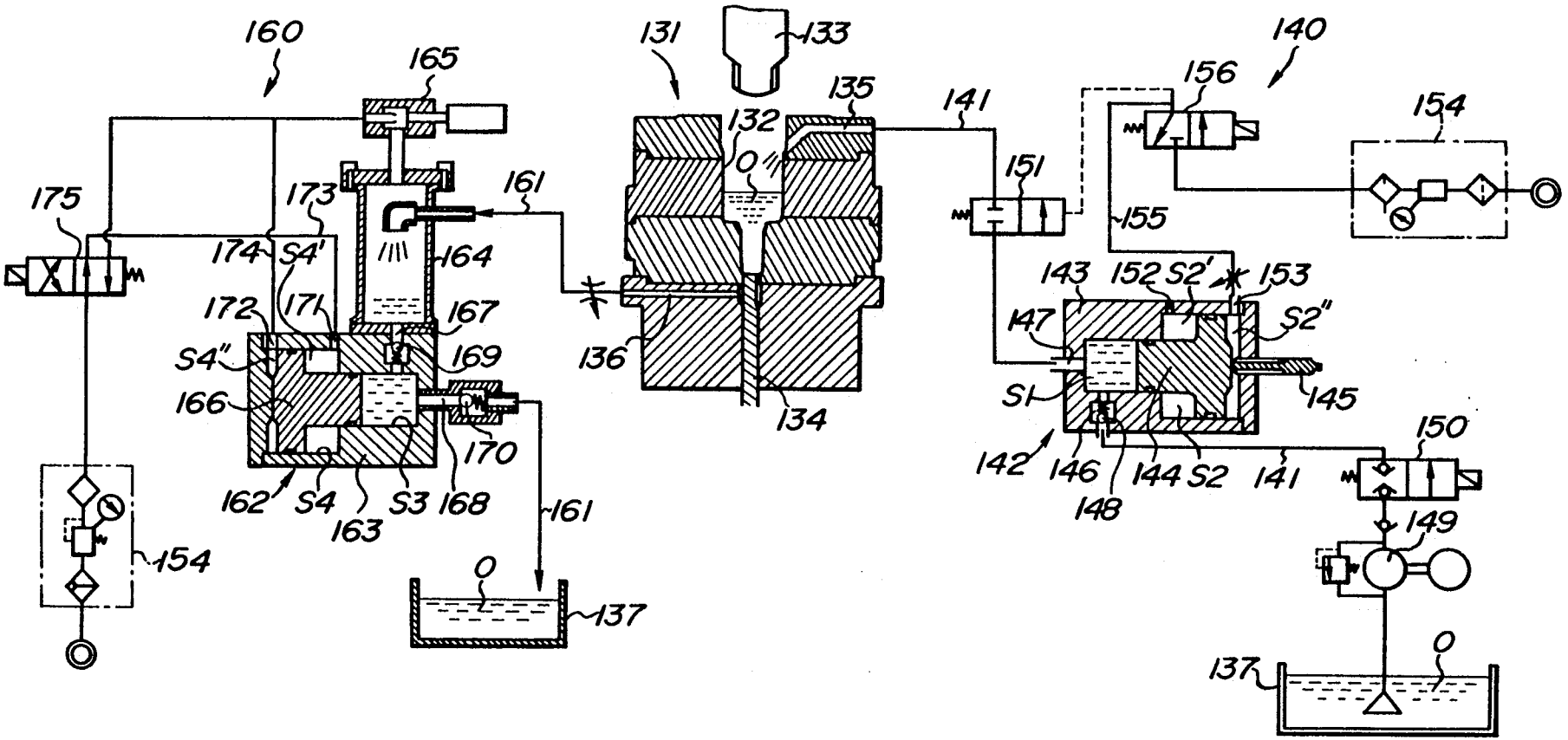
FIG. 25 is a diagram of a lubricating oil supply/discharge system in the working apparatus shown in FIG. 16.

FIG. 25 shows a lubricating oil supply/discharge system in the working apparatus illustrated in FIG. 16.

A lubricating oil supply device 140 has a cylinder unit 142 connected in a pipe 141 between a lubricating oil tank 137 and a supply passage 135 communicating with a cavity 132 in a die assembly 131. The cylinder unit 142 serves to supply a constant amount of lubricating oil to the cavity 132 in a short period time. The cylinder unit 142 has a cylinder 143 defining therein a smaller-diameter oil chamber S1 and a larger-diameter air chamber S2, and a piston 144 having a smaller-diameter portion slidably disposed in the oil chamber S1 and a larger-diameter portion slidably disposed in the air chamber S2. The larger-diameter portion of the piston 144 divides the air chamber S2 into subchambers S2', S2''. A stopper pin 145 which is positionally adjustable from outside projects into the chamber S2''.

The cylinder 143 has oil passages 146, 147 defined therein and opening into the oil chamber S1, with a check valve 148 disposed in the oil passage 146. Lubricating oil O pumped from the tank 137 by a motor-operated pump 149 is delivered via a solenoid-operated valve 150 and the check valve 148 into the oil chamber S1 where the oil is temporarily stored. The oil passage 147 is connected to the supply passage 135 by a portion of the pipe 141 having a valve 151. The cylinder 143 also has air flow passages 152, 153 opening into the subchambers S2', S2", respectively. The air flow passage 153 is connected to a pipe 155 extending from a pressurized air source 154 and having a solenoid-operated valve 156. The solenoid-operated valve 156 operates to selectively supply air under pressure from the pressurized air source 154 into the subchamber S2" and to actuate the valve 151.

A lubricating oil discharge device 160 has a cylinder unit 162 connected in a pipe 161 between the lubricating oil tank 137 and a discharge passage 136 communicating with the cavity 132. The cylinder unit 162 serves to discharge a constant amount of lubricating oil from the cavity 132 in a short period of time to the tank 137. The cylinder unit 162 includes a cylinder 163 and a closed tank 164 mounted vertically on the cylinder 163 with one end of the pipe 161 extending into the tank 164. An ejector 165 is mounted on the closed tank 164 for generating a vacuum with air supplied from the pressurized air source 154, the ejector 165 having a vacuum generating chamber communicating with the closed tank 164.

The cylinder 163 defines therein a smaller-diameter oil chamber S3 and a larger-diameter air chamber S4. A piston 166 has a smaller-diameter portion slidably disposed in the oil chamber S3 and a larger-diameter portion slidably disposed in the air chamber S4 and dividing the air chamber S4 into subchambers S4', S4". The cylinder 163 has an oil passage 167 opening into the oil chamber S3 and communicating with the closed tank 164, and an oil passage 168 opening into the oil chamber S3 and communicating with the passage 161 connected to the tank 137. The oil passages 167, 168 have respective check valves 169, 170 positioned therein for allowing lubricating oil O to flow in one direction only.

The cylinder 163 also has air flow passages 171, 172 opening into the subchambers S4', S4", respectively. Compressed air can be supplied from the pressurized air source 154 selectively into the subchambers S4', S4" via pipes 173, 174 and a solenoid-operated valve 175.

A process of forming a cup-shaped component with a shank, such as an outer ring for a constant-velocity joint, using an extrusion apparatus combined with the lubricating oil supply/discharge system thus arranged, will be described below with reference to FIGS. 26 and 27.

Figure 26A:
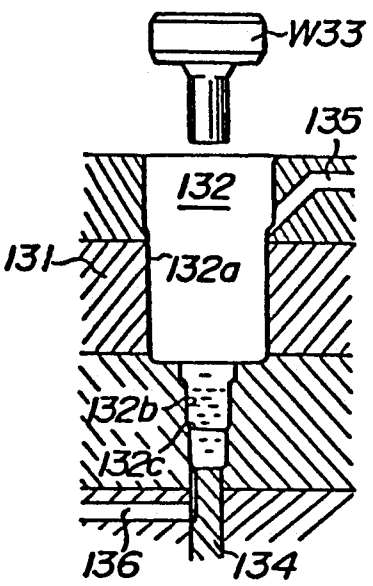
FIGS. 26(A) through 26(G) are cross-sectional views illustrating the manner in which lubricating oil is supplied and discharged by the system of FIG. 25.

As illustrated in FIG. 26(A), a billet W33 is unclamped above the cavity 132 and placed into the cavity 132. At this time, lubricating oil O is left up to a certain level above the bottom of a smaller-diameter hole 132*b*, but below a larger-diameter hole 132*a* of the cavity 132. The level of the lubricating oil O in the cavity 132 can be adjusted by the constant-quantity discharge cylinder unit 162, or may be adjusted by varying the diameter of the discharge passage 136.

Figure 26B:
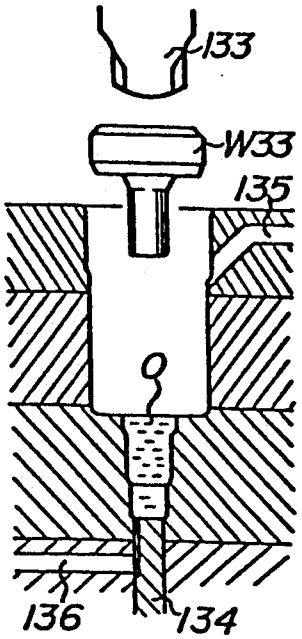
Figure 26C:
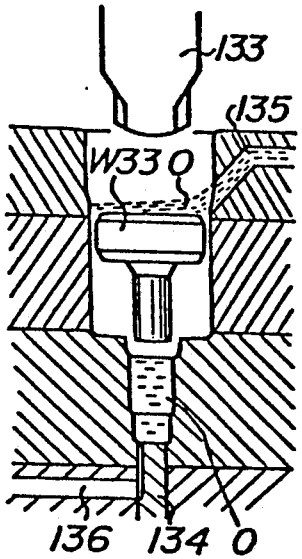
Figure 26D:
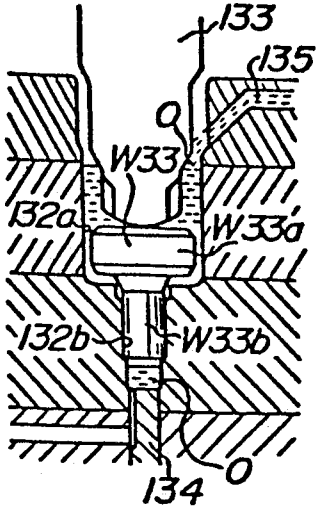
Figure 27:
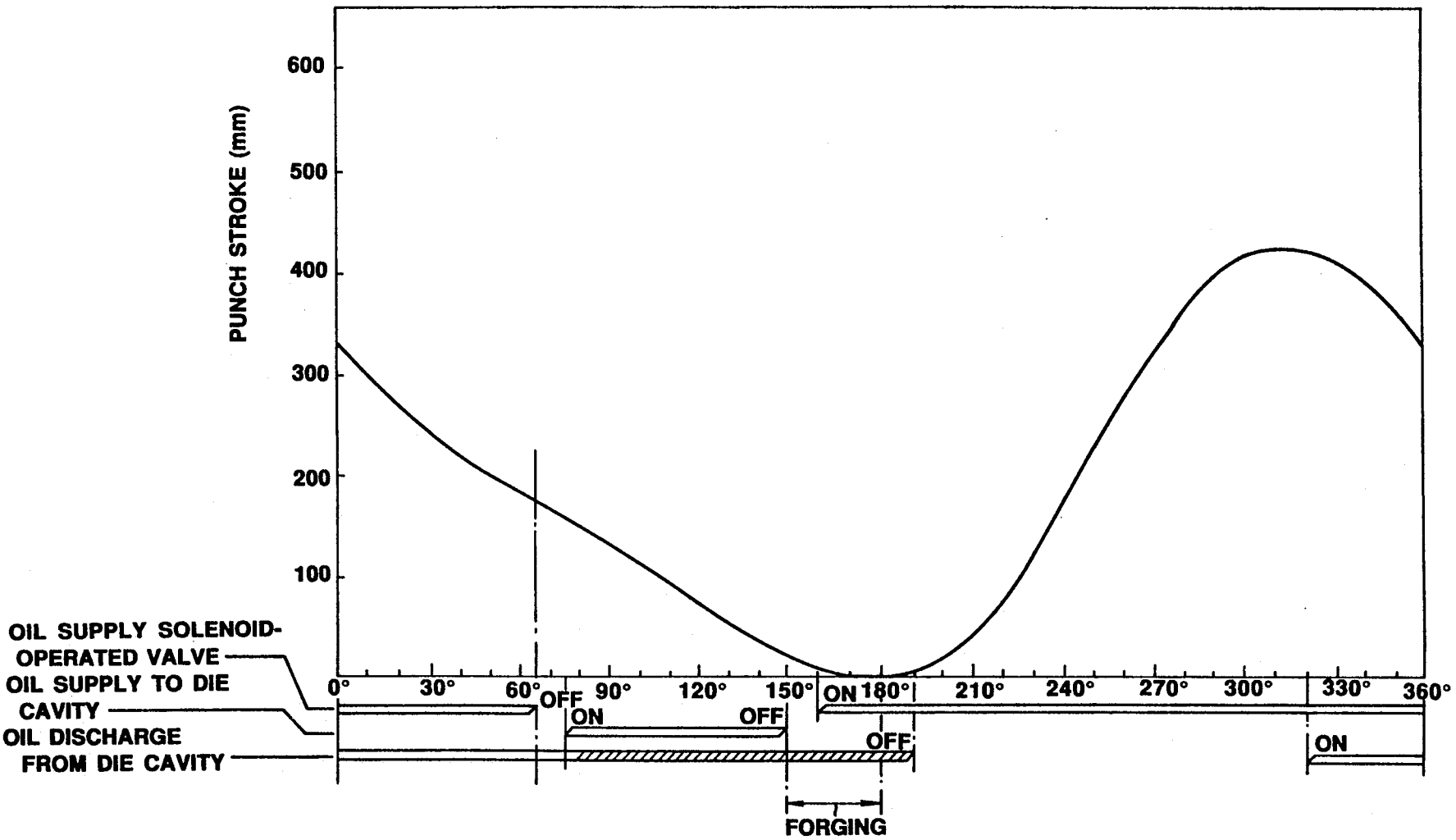
FIG. 27 is a graph showing a punch stroke and timing for opening and closing a supply/discharge valve.

Substantially at the same time that the billet W33 is placed in the cavity 132, a punch 133 is lowered as shown in FIG. 26(B) at a 0° position (lefthand side) in FIG. 27. The angles shown in FIG. 27 refer to the angular displacement of a rotating crankshaft (not shown) connected to the punch 133 for vertically moving the punch 133. At this time, the solenoid-operated valve 150 is actuated (i.e., moved to the left from the position of FIG. 25), and the valves 151, 156 are inactivated. Lubricating oil O pumped from the tank 137 is forced via the check valve 148 into the oil chamber S1 to move the piston 144 to the right in FIG. 25 until the piston 144 engages the stopper pin 145. The lubricating oil O is supplied into the oil chamber S1 in a constant amount, and any lubricating oil supplied in excess of the constant amount which has already been supplied is returned via a bypass (not shown) into the tank 137.

Figure 26G:
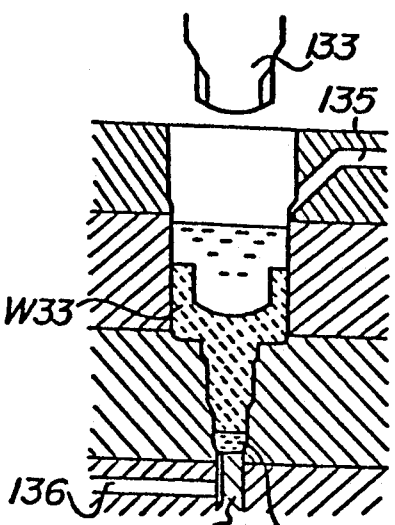

When the billet W33 falls in the cavity 132 and the punch 133 is lowered to a predetermined position in the cavity 132 (at a 65° position in FIG. 27), the solenoid-operated valve 150 is inactivated as shown in FIG. 25. When the punch 133 is further lowered (at a 75° position in FIG. 27), the solenoid-operated valve 156 is actuated. The piston 144 is now moved to the left by air pressure supplied to the subchamber S2", and the valve 151 is opened to supply the lubricating oil O from the oil chamber S1 into the cavity 132 over the upper surface of the billet W33 within a short period of time. Thereafter, before the lower surface of a larger-diameter head W33*a* of the billet W33 hits the bottom of the larger-diameter hole 132*a*, the punch 133 engages the upper surface of the billet W33 and lowers the billet W33, forming a step W33*d* on a shank W33*b*. The lubricating oil O is continuously supplied up to a time (at a 150° position in FIG. 27) immediately before the punch 133 starts forging the billet W33 as shown in FIG. 26(E).

At this time, the lubricating oil O remaining in the smaller-diameter hole 132*b* raises its level to fill the gap between the shank W33*b* and the inner surface of the smaller-diameter hole 132*b* with the lubricating oil O under its back pressure. Since there is a gap present between the larger-diameter head W33*a* of the billet W33 and the inner surface of the larger-diameter hole 132*a* of the cavity 132, the lubricating oil O supplied from above flows quickly around and below the larger-diameter head W33*a*, so that the entire surfaces of the billet W33 are covered with the lubricating oil O.

Figure 26F:
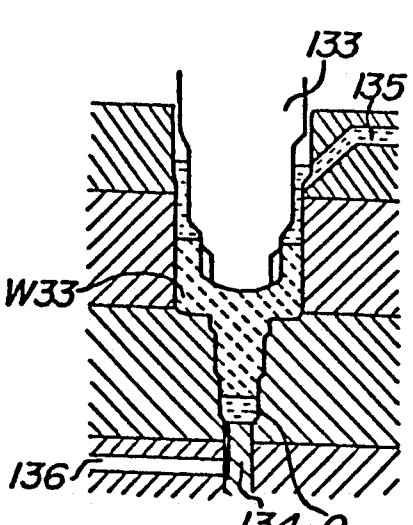
Figure 26E:
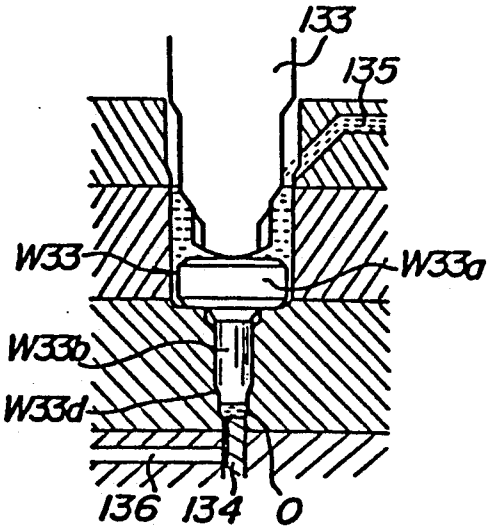

As shown in FIG. 26(F), the intermediate and lower portions of the billet W33 are extruded forwardly, and the upper portion of the billet W33 is extruded backwards into a cup shape. After the billet W33 has thus started to be forged, the solenoid-operated valve 150 is actuated again to supply the lubricating oil O to the oil chamber S1 of the cylinder unit 142 in preparation for a next forging cycle (see FIG. 27).

The forging of the billet W33 will be described in greater detail below with regard to FIGS. 28–30.

Figure 28:
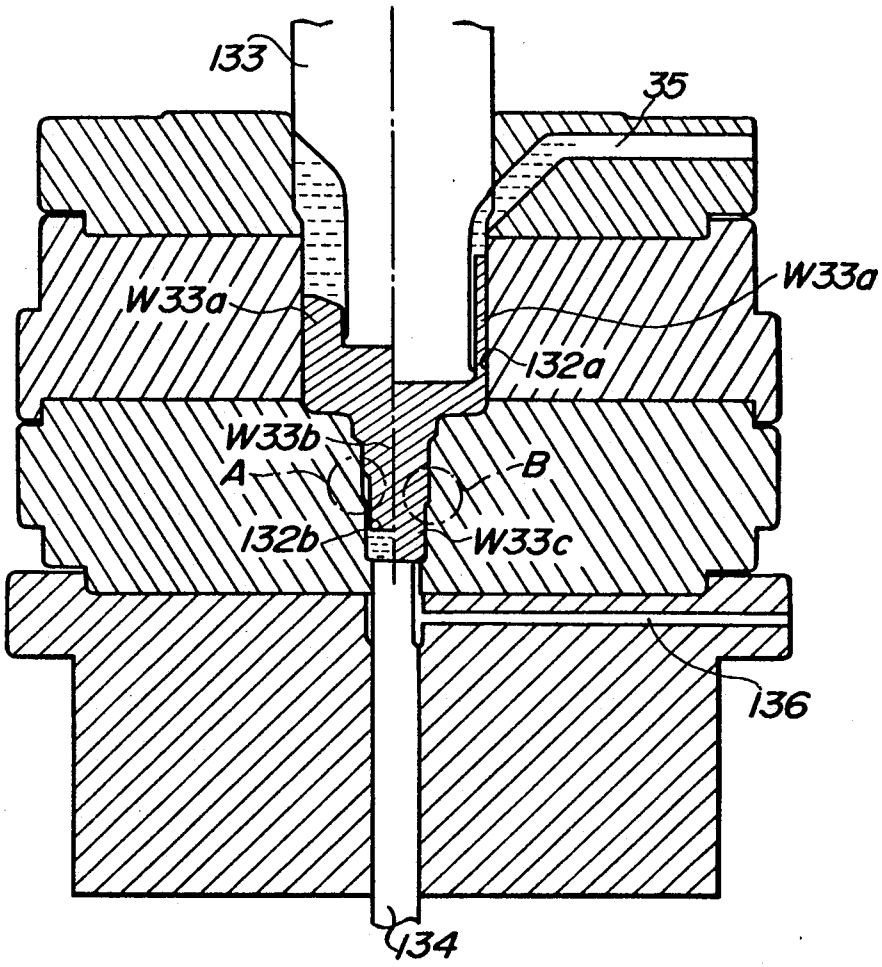
FIG. 28 is an enlarged cross-sectional view showing a billet being forged and after having been forged.
Figure 29:
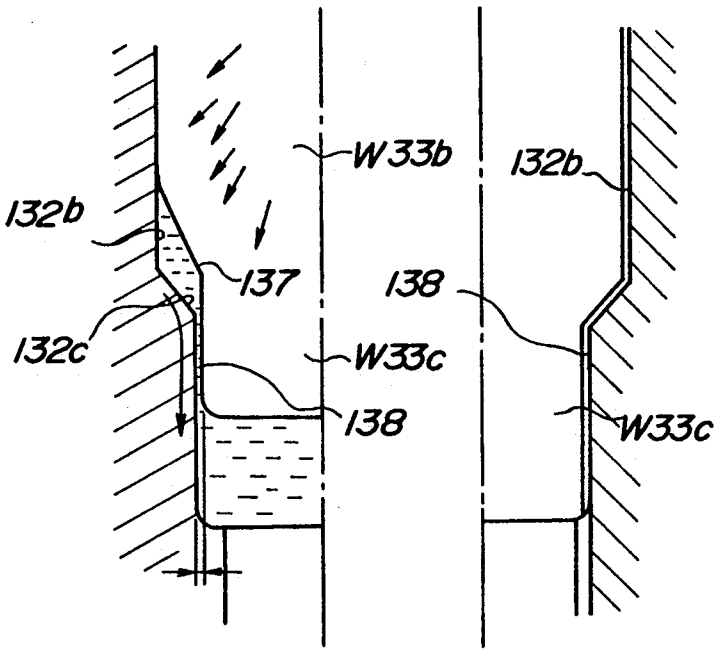
FIG. 29 shows enlarged views of areas A, B, respectively, of FIG. 28.

When the punch 133 is lowered to start extruding the larger-diameter head W33*a* backwards as shown in the righthand side of FIG. 28, the shank W33*b* of the billet W33 is spread laterally under pressure as shown in FIG. 29(A) to form the step W33*d* on the shaft W33*b* and define a lubricating oil storing space 137 between the inner surface of the smaller-diameter hole 132*b* and the shank W33*b*. The lubricating oil O in the lubricating oil storing space 137 provides a lubricating film 138 between the inner surface of the smaller-diameter hole 132*b* and a smaller-diameter stepped shank portion W33*c* which is extruded forwardly by squeezing the shank W33*b* with a step 132*c* in the smaller-diameter hole 132*b*. Part of the lubricating oil O in the space 137 spreads upwardly to prevent galling.

Thereafter, the punch 133 is further lowered to complete the formation of the cup-shaped portion W33*a* and the smaller-diameter stepped shank portion W33*c* as shown in the righthand side of FIG. 28 and in FIG. 29(B).

Figure 30:
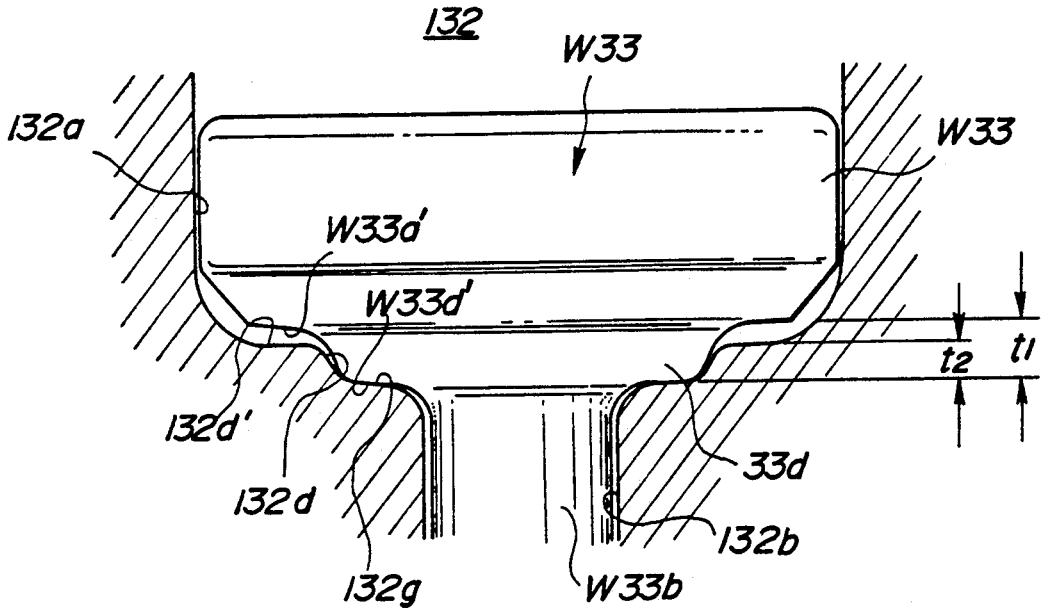
FIG. 30 is an enlarged cross-sectional view showing the relationship between the dimension of a step between a larger-diameter head and a shank of a billet and the dimension of a portion of a cavity for forming that step.

As shown in FIG. 30, a step W33*d* of the billet W33 between the larger-diameter head W33*a* and the smaller-diameter shank W33*b* has an axial dimension t1 which is larger than the axial dimension t2 of a corresponding step 132*d* in the cavity 132. Therefore, the lower surface W33*d'* of the billet step W33*d* engages the lower flat surface 132*g* of the cavity step 132*d* before the lower surface W33*a'* of the head W33*a* hits and the upper surface 132*d'* of the cavity step 133*d*. As a consequence, when the larger-diameter head W33*a* and the smaller-diameter shank W33*b* are extruded in vertically opposite directions from the step W33*d*, the step W33*d* does not suffer wrinkles or other defects which would otherwise be caused by an oil shortage.

After the billet W33 has been forged into a product W34, the punch 133 is lifted as shown in FIG. 26(G), and the product W34 is ejected from the die assembly by an ejector pin 134. The punch 133 is elevated and then starts being lowered again past a top dead center (at a 320° position in FIG. 27), after which part of the lubricating oil O in the cavity 132 is returned to the tank 137 by the discharge device 160. The discharge device 160 operates after the billet has been placed in the cavity 132, and continues to operate while the lubricating oil is being supplied and the billet starts to be forged, until the punch 133 moves past a bottom dead center (at a 190° position in FIG. 27). In an interval which is shown as being hatched in FIG. 27 (between 75° and 190°), the bottom of the cavity 132 is sealed by the billet W33, and hence no lubricating oil is discharged except when the punch 133 is lowered without any billet in the cavity 132.

The discharge device 160 operates as follows:

When the solenoid-operated valve 175 is moved to the right from the position of FIG. 25, air from the pressurized air source 154 flows into the ejector 165. Since the vacuum generating space in the ejector 165 communicates with the closed tank 164, the tank 164 is evacuated to draw the lubricating oil O from the cavity 132 into the tank 164. At the same time, air is also supplied to the air chamber S4" in the cylinder 163 to move the piston 166 to the right. The lubricating oil O in the oil chamber S3 opens the check valve 170 and is discharged into the tank 137.

Thereafter, the solenoid-operated valve 175 is shifted back to the position of FIG. 25 under the bias of the spring. Air from the pressurized air source 154 then flows into the other air chamber S4' to retract the piston 166 to reduce the pressure in the oil chamber S3. The check valve 169 is lowered to draw the lubricating oil O from the tank 164 into the oil chamber S3.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. A method of successively cold working a billet, comprising the steps of:

(a) forming a chemically converted lubricating coating on a surface of the billet;

(b) forging said billet into an intermediate product at a temperature below a transformation temperature of the billet;

(c) positioning said intermediate product in a die cavity in a die assembly;

(d) entirely immersing and covering said intermediate product with lubricating oil while said intermediate product is positioned in said die cavity in said die assembly; and (e) forging said intermediate product at a temperature below the transformation temperature substantially simultaneously with a step (d) before the intermediate product gains a predetermined hardness due to age hardening resulting rom said forging step (b).

2. A method of successively cold working a billet comprising the steps of:

(a) forming a chemically converted lubricating coating on a surface of the billet;

(b) forging said billet into an intermediate product at a temperature below a transformation temperature of the billet;

(c) covering a surface of said intermediate product with lubricating oil in a die cavity in a die assembly; and (d) forging said intermediate product at a temperature below the transformation temperature before the intermediate product gains a predetermined hardness due to age hardening resulting from said forging step (b);

said step (c) comprising the step of filling said die cavity with the lubricating oil, and said step (d) comprising the step of forcing said intermediate product into said die cavity.

3. A method according to claim 2, further including the steps of:

pressurizing the lubricating oil in said die cavity up to a predetermined pressure by forcing the intermediate billet into said die cavity; and discharging part of the lubricating oil from said die cavity to maintain said predetermined pressure when the pressure of the lubricating oil exceeds said predetermined pressure during said step (d).

4. A method according to claim 3, wherein the lubricating oil is discharged from a lower end of said die cavity.

5. A method according to claim 2, wherein said lubricating oil is thermally reactive and comprises naphthenic base oil with a calcium additive and sulfurized oil added thereto.

6. A method according to claim 2, wherein the second forging step (d) ends within 18 seconds after the first forging step (b).

7. A method according to claim 2, wherein said billet is forged to form a larger-diameter head on the intermediate product in said step (b), and the head of said intermediate product is forged into a cup shape in said step (d).

8. A method according to claim 7, wherein said step (b) comprises the step of upsetting said billet, and said step (d) comprises the step of extruding said head of the intermediate product backwards.

9. A method according to claim 8, wherein a total principal logarithmic strain of the intermediate product after said step (d) is $\ln\phi g \geqq 0.6$ where said billet and said intermediate product are made of carburized hardened steel.

10. A method according to claim 7, including a step of forming a relief hole in said die assembly for releasing the lubricating oil, said relief hole being formed so as to open into said die cavity in an area where a space for confining the lubricating oil tends to be defined between an inner surface of the cavity and said intermediate product, said area positionally corresponding to a thicker portion of the intermediate product.

11. A method according to claim 7, wherein said intermediate product has a shank, said step (d) including the step of forming a step on said shank.

12. A method according to claim 11, further including the step of:

forwardly extruding said shank on said billet prior to said step (b).

13. A method according to claim 11, wherein said shank and said head of said intermediate product are extruded forwardly and backwards, respectively, and said billet is formed in said step (b) such that said intermediate product has an intermediate portion between said head and said shank, said intermediate portion having an axial dimension larger than the axial dimension of a portion of said die assembly which forms said intermediate portion.

14. A method according to claim 2, wherein said lubricating oil is circulated between a tank and said die cavity.

15. A method of successively cold working a billet, comprising the steps of:

(a) forming a chemically converted lubricating coating on a surface of the billet;

(b) forging said billet into an intermediate product at a temperature below a transformation temperature of the billet;

(c) placing the intermediate product in a die cavity in a die assembly and covering a surface of said intermediate product with lubricating oil as disposed in the die assembly; and (d) forging said intermediate product at a temperature below the transformation temperature before the intermediate product gains a predetermined hardness due to age hardening resulting from said forging step (b);

said step (c) comprising the step of supplying the lubricating oil into the die cavity from above the intermediate product; and keeping the lubricating oil filled up to a position higher than an upper surface of said intermediate product during the step (d).

16. A method according to claim 15, wherein said die assembly has lubricating oil supply and discharge passages defined therein and having ends opening into said die cavity above said intermediate product placed in said die cavity, said supply passage being connected to a check valve for preventing lubricating oil from flowing back from the die cavity.

17. A method according to claim 15, wherein the lubricating oil is supplied in a first predetermined amount toward the upper surface of the intermediate product placed in the die cavity for a first period of time, and the lubricating oil is forcibly discharged in a second predetermined amount from a bottom of said die cavity for a second period of time.

18. A method according to claim 17, wherein said first period of time extends after the intermediate product has been placed in said die cavity until the intermediate product starts being forged, and said second period of time extends after a forging punch starts being lowered into said die cavity past a top dead center until the forging punch moves past a bottom dead center.

19. A method of successively cold working a billet, comprising the steps of:

(a) forming a chemically converted lubricating coating on a surface of the billet;

(b) forging said billet into an intermediate product at a temperature below a transformation temperature of the billet;

(c) covering a surface of the intermediate product with lubricating oil in a die cavity in a die assembly; and (d) forging said intermediate product at a temperature below the transformation temperature before the intermediate product gains a predetermined hardness due to age hardening resulting from said forging step (b);

said lubricating oil is circulated between a tank and said die cavity; and said lubricating oil is cooled or heated to keep the temperature thereof in the range of from 20° C. to 40° C. thereby keeping the temperature of the die assembly in the range of from 100° C. to 400° C. and the temperature of the billet in the range of from 150° C. to 300° C.

20. A method of forming a component having a stepped shank and a cup-shaped portion, comprising the steps of:

supplying lubricating oil into a die cavity having an upper larger-diameter hole and a lower smaller-diameter hole contiguous to said larger-diameter hole, until the lubricating oil is filled up to a predetermined height in said smaller-diameter hole;

placing a billet having an upper larger-diameter head and a lower smaller-diameter shank in said die cavity so that said head is positioned in said larger-diameter hole and said shank is positioned in said smaller-diameter hole;

supplying lubricating oil toward an upper end of said billet until an upper surface of said billet is covered with the lubricating oil; and thereafter, lowering a punch into said die cavity to extrude said head backwards into a cup shape and said shank forwardly into a stepped shank.

* * * * *

UNITED STATES PATENT AND TRADEMARK OFFICE

CERTIFICATE OF CORRECTION

PATENT NO. : 5,007,266

DATED : April 16, 1991

INVENTOR(S) : NISHIUCHI ET AL.

It is certified that error appears in the above-identified patent and that said Letters Patent is hereby corrected as shown below:

On the title page:
In the Abstract, line 9, change "intermdiate" to -- intermediate --.

Col. 3, line 31, change "6(D)" to -- 6(E) --.

Col. 4, line 23, change "11,21,32" to --11,21,31 --.
Col. 5, line 5, change "30wt%%"to -- 30 wt% --;
line 20, change "C." to -- C --;
line 21, change "C.," to -- C, --;
line 32, change "CU" to -- Cu --;
line 64, change "200 °C." to -- 200°C--.
Col. 7, line 43, change "150°C. to 400°C." to -- 150°C to 400°C --.
Col. 8, line 20, change "W1" to -- W11 --;
line 65, change " a had b" to -- a head b --.
Col. 9, line 38, change "20°C.," to --20°C,--;
line 42, change "40°C.," to --40°C,--;
line 45, change "20°C. to" to -- 20°C to --;
line 48, change "100°C. to" to --100°C to --;
line 59, change "100°C. to 400°C."to --100°C to 400°C --;
line 62, change "150°C. to 300°C." to --150°C to 300°C --.
Col. 10, line 25, change ")product" to --(product --.
Col. 13, line 9, change "133d." to -- 132d. --.
Col. 14, line 11, change "rom" to -- from --.
Col. 16, line 30, change "20°C." to -- 20°C --;
line 31, change "40°C." to --40°C --;
line 32, change "100°C. to 400°C." to -- 100°C to 400°C --;

UNITED STATES PATENT AND TRADEMARK OFFICE

CERTIFICATE OF CORRECTION

PATENT NO. : 5,007,266

DATED : April 16, 1991

INVENTOR(S) : NISHIUCHI ET AL.

It is certified that error appears in the above-identified patent and that said Letters Patent is hereby corrected as shown below:

Col. 16, line 34, change "150°C." to -- 150°C --.

Signed and Sealed this

Third Day of November, 1992

*Attest:*

DOUGLAS B. COMER

*Attesting Officer*

*Acting Commissioner of Patents and Trademarks*